US010549958B2

(12) United States Patent
Yudate et al.

(10) Patent No.: US 10,549,958 B2
(45) Date of Patent: Feb. 4, 2020

(54) ROPE HOIST

(71) Applicant: KITO CORPORATION, Nakakoma-gun, Yamanashi (JP)

(72) Inventors: Fujito Yudate, Yamanashi (JP); Kazuho Furukawa, Yamanashi (JP); Masayoshi Itoda, Yamanashi (JP)

(73) Assignee: KITO CORPORATION, Nakakoma-Gun, Yamanashi (JP)

( * ) Notice: Subject to any disclaimer, the term of this patent is extended or adjusted under 35 U.S.C. 154(b) by 468 days.

(21) Appl. No.: 15/311,748

(22) PCT Filed: Mar. 29, 2015

(86) PCT No.: PCT/JP2015/065661
§ 371 (c)(1),
(2) Date: Nov. 16, 2016

(87) PCT Pub. No.: WO2015/182772
PCT Pub. Date: Dec. 3, 2015

(65) Prior Publication Data

US 2017/0107084 A1 Apr. 20, 2017

(30) Foreign Application Priority Data

May 30, 2014 (JP) ..... 2014-113376

(51) Int. Cl.
*B66C 11/00* (2006.01)
*B66C 11/16* (2006.01)
(Continued)

(52) U.S. Cl.
CPC ..... *B66C 11/00* (2013.01); *B66C 11/16* (2013.01); *B66C 13/18* (2013.01); *B66C 19/00* (2013.01);
(Continued)

(58) Field of Classification Search
CPC ..... B66C 11/00; B66C 11/06; B66C 11/16; B66C 13/18; B66C 19/00; B66C 23/72;
(Continued)

(56) References Cited

U.S. PATENT DOCUMENTS 4,667,776 A * 5/1987 Nomura ..... B66B 1/308 187/289
6,250,484 B1 6/2001 Bartelme
(Continued)

FOREIGN PATENT DOCUMENTS

CN 2319389 Y 5/1999
CN 2903001 Y 5/2007
(Continued)

OTHER PUBLICATIONS

SIPO First Office Action corresponding to Application No. 201580026675.6; dated May 17, 2018.
(Continued)

*Primary Examiner* — Michael E Gallion
(74) *Attorney, Agent, or Firm* — Cantor Colburn LLP

(57) ABSTRACT

A rope hoist which hoists and lowers a cargo via a wire rope includes: a frame structure which rotatably supports a wheel; a rope drum mechanism which is provided on one side of the frame structure in a width direction, and includes a drum motor which rotates the rope drum; a counterweight which is provided on another side of the frame structure in the width direction and is arranged in a state of having a space with respect to the frame structure; and a control unit which is attached to a side of the counterweight opposite to the rope drum mechanism in the width direction and inverter-controls the drum motor, to the rope drum mechanism side of the counterweight, a braking resistor part which processes regenerative electric power in the inverter control is attached in a state of being located in the space.

8 Claims, 24 Drawing Sheets

(51) Int. Cl.

| | |
|---|---|
| ***B66C 13/18*** | (2006.01) |
| ***B66C 19/00*** | (2006.01) |
| ***B66C 23/72*** | (2006.01) |
| ***B66C 23/88*** | (2006.01) |

(52) U.S. Cl.
CPC ..... *B66C 23/72* (2013.01); *B66C 23/88* (2013.01); *B66C 2700/012* (2013.01); *B66C 2700/087* (2013.01)

(58) Field of Classification Search
CPC ..... B66C 23/88; B66C 2700/012; B66C 2700/087; B66D 3/20; B66D 3/22; B66D 3/26
See application file for complete search history.

(56) References Cited

U.S. PATENT DOCUMENTS

| | | | | |
|---|---|---|---|---|
| 6,564,954 | B1 * | 5/2003 | Buhlmayer | B66C 11/06 212/328 |
| 9,048,698 | B2 * | 6/2015 | Hiroshima | B66D 3/20 |
| 2013/0221809 | A1 * | 8/2013 | Hiroshima | B66D 3/20 310/60 R |
| 2017/0081152 | A1 * | 3/2017 | Kosuga | B66C 1/34 |
| 2018/0346295 | A1 * | 12/2018 | Kosuga | B66D 1/28 |

FOREIGN PATENT DOCUMENTS

| | | | |
|---|---|---|---|
| CN | 201450478 | U | 5/2010 |
| CN | 202864799 | U | 4/2013 |
| CN | 203269442 | U | 11/2013 |
| CN | 203419704 | U | 2/2014 |
| DE | 8812534 | U1 | 12/1988 |
| DE | 10204372 | A1 | 8/2003 |
| JP | 08133685 | A | 5/1996 |
| JP | 2012111610 | A | 6/2012 |
| JP | 2012158474 | A | 8/2012 |
| JP | 2013511450 | A | 4/2013 |
| WO | 2011061129 | A1 | 5/2011 |

OTHER PUBLICATIONS

International Search Report corresponding to Application No. PCT/JP2015/065661; dated Aug. 18, 2015, with English translation.
Extended European Search Report corresponding to Application No. 15799750.3-1731/3150546 PCT/JP2015065661; dated Dec. 22, 2017.

* cited by examiner

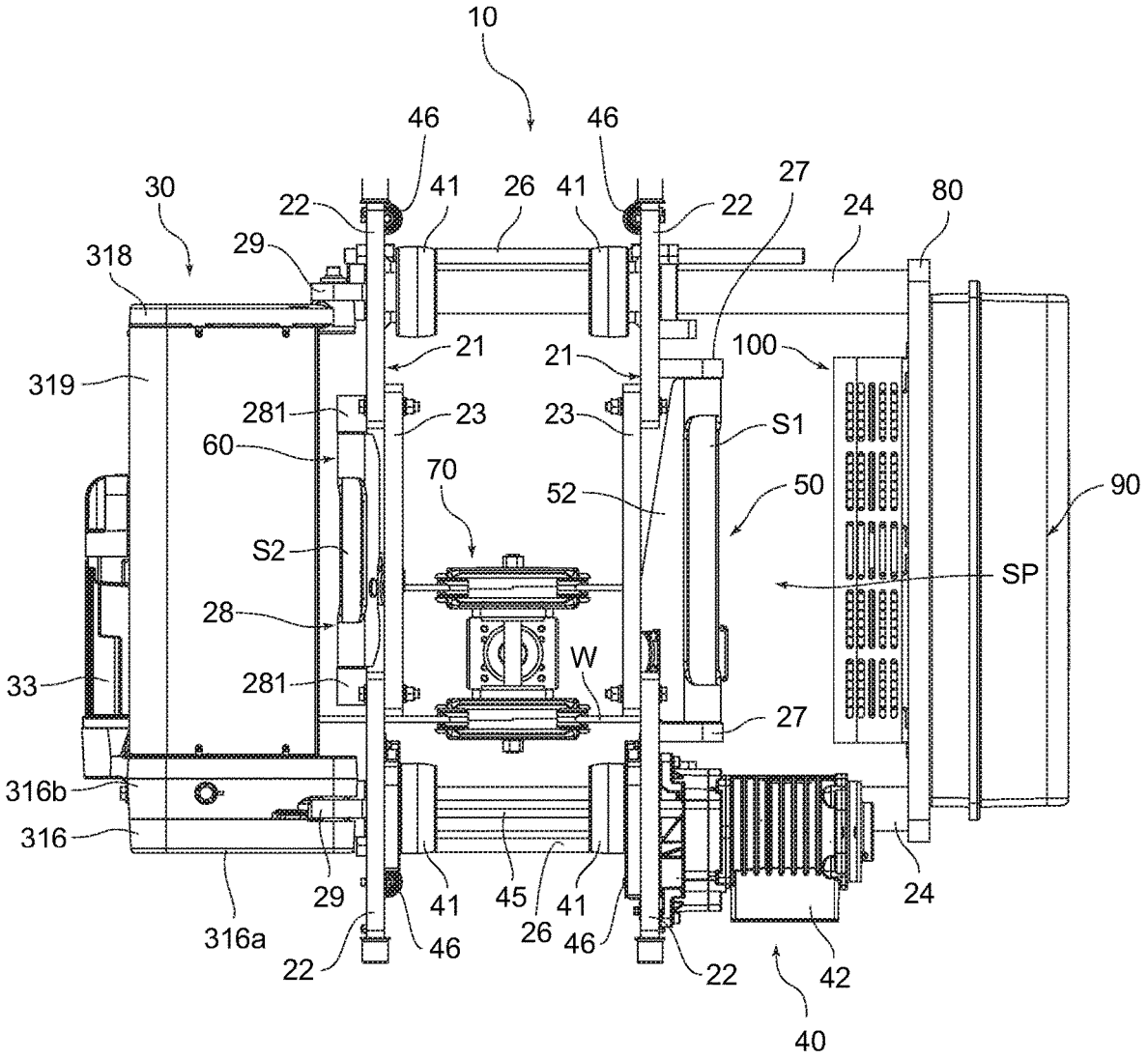
Fig.3
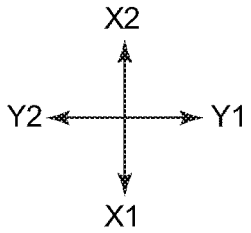

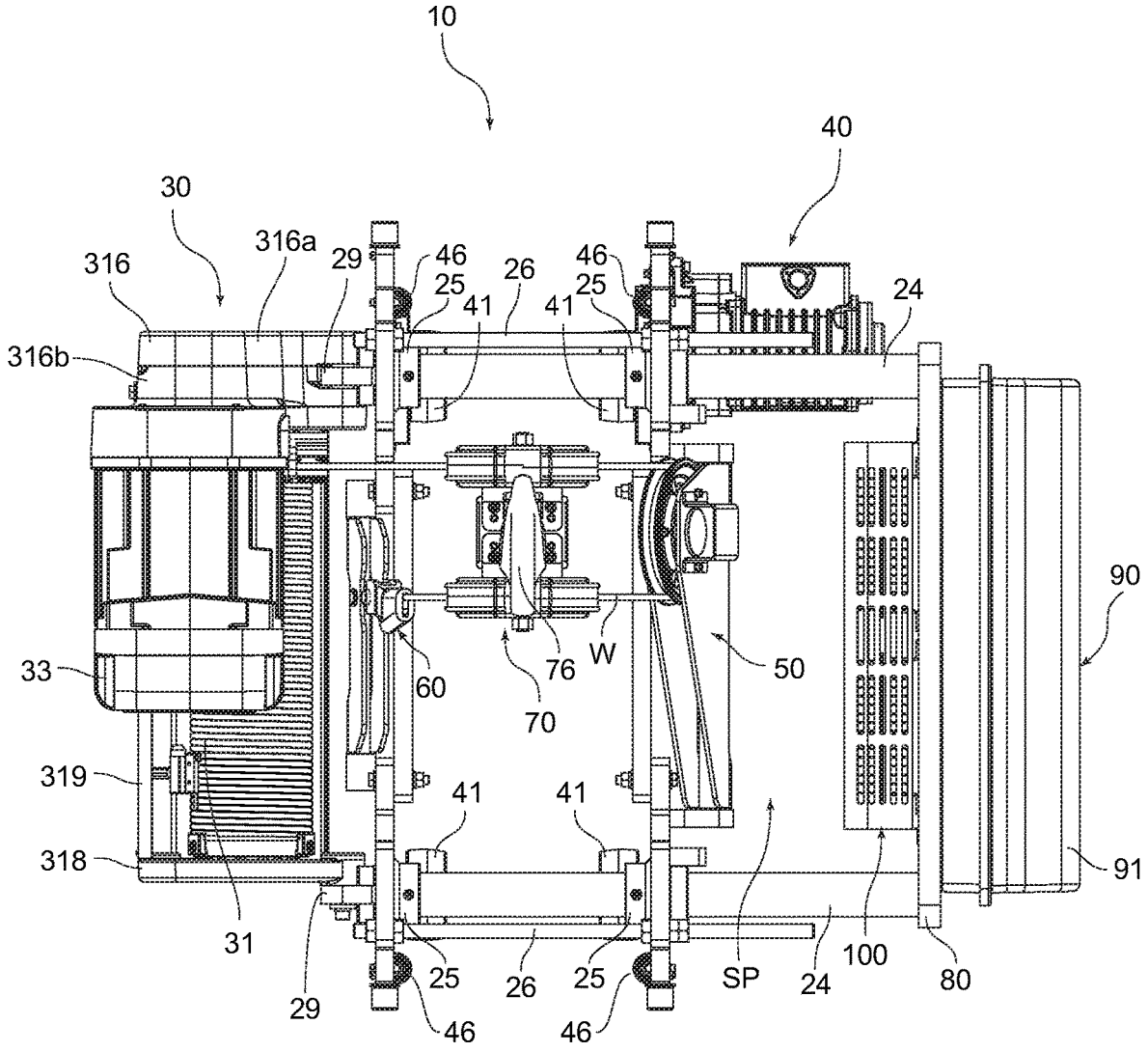
Fig.4
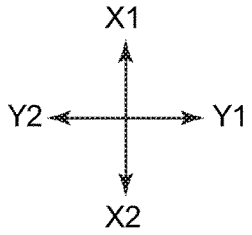

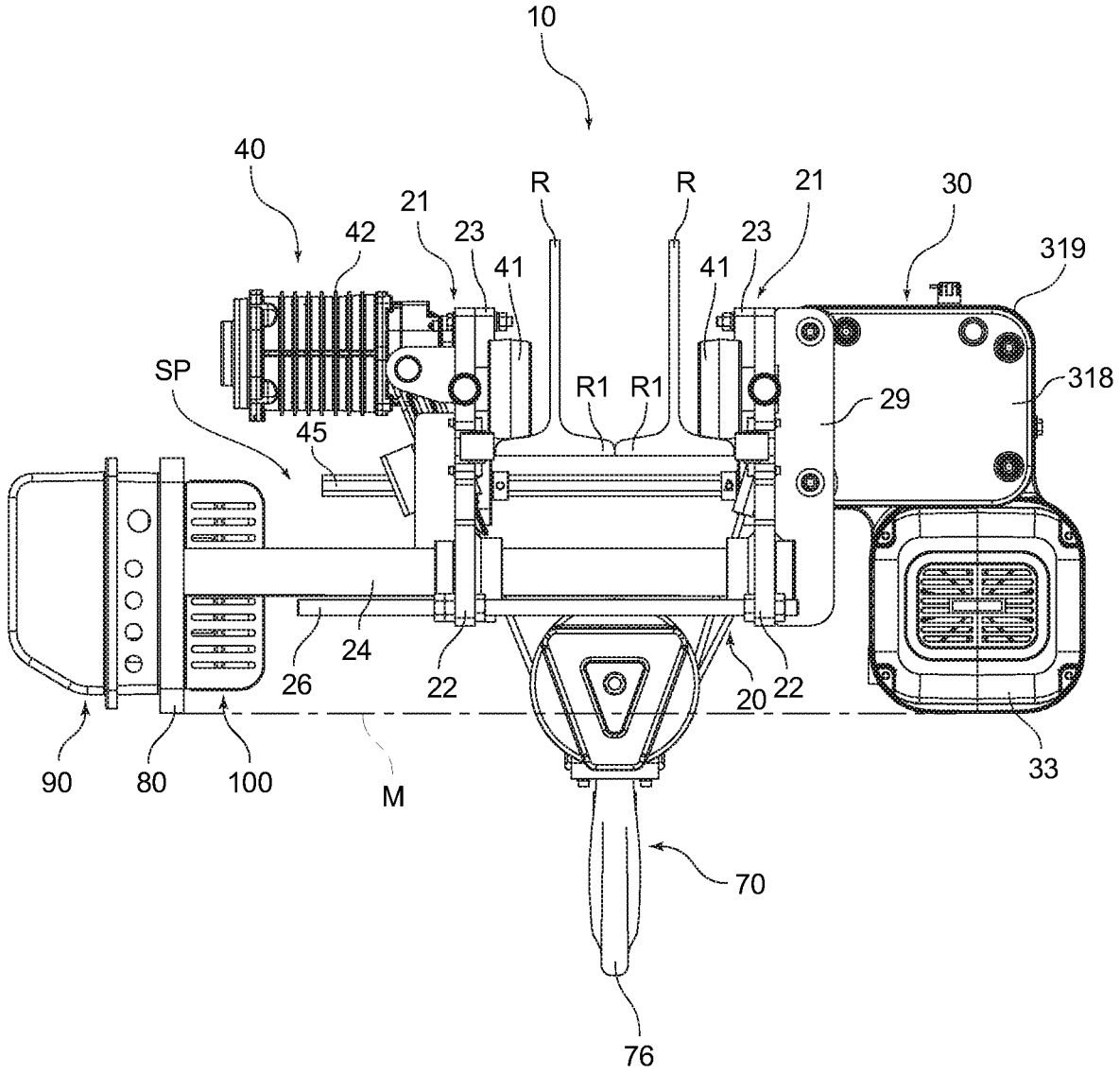
Fig.6
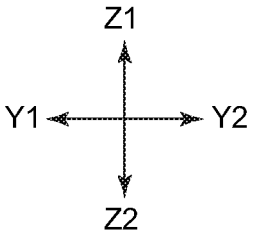

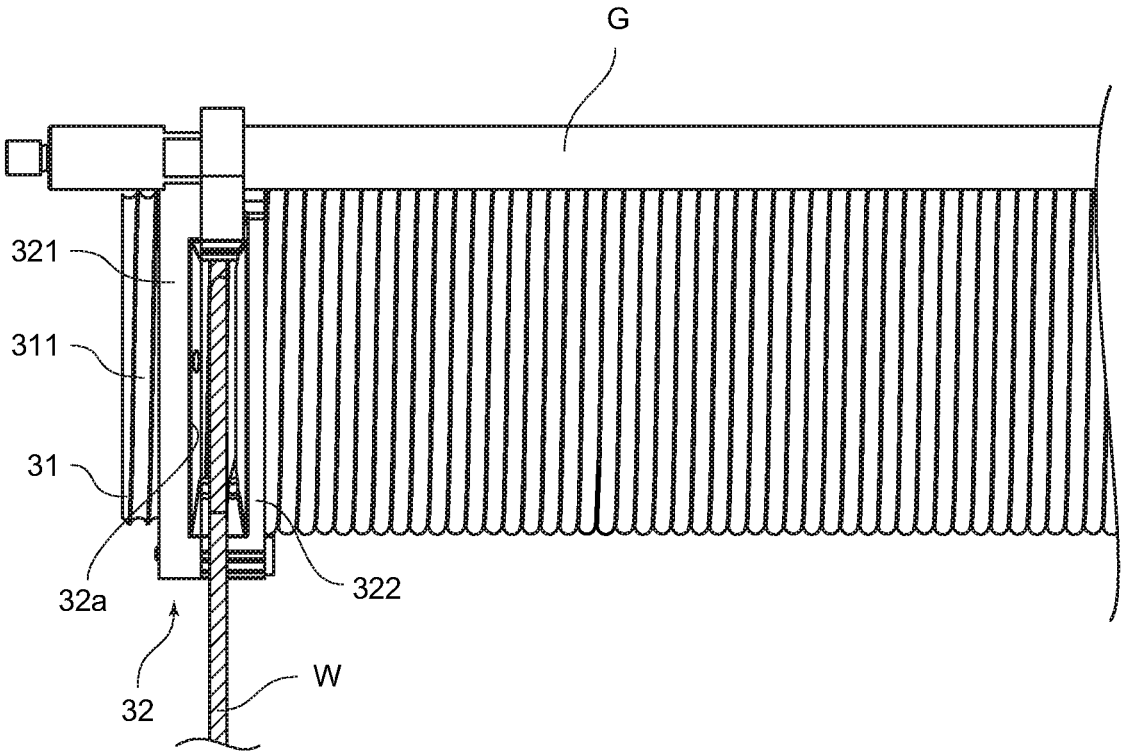
Fig.9
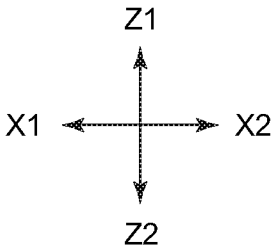

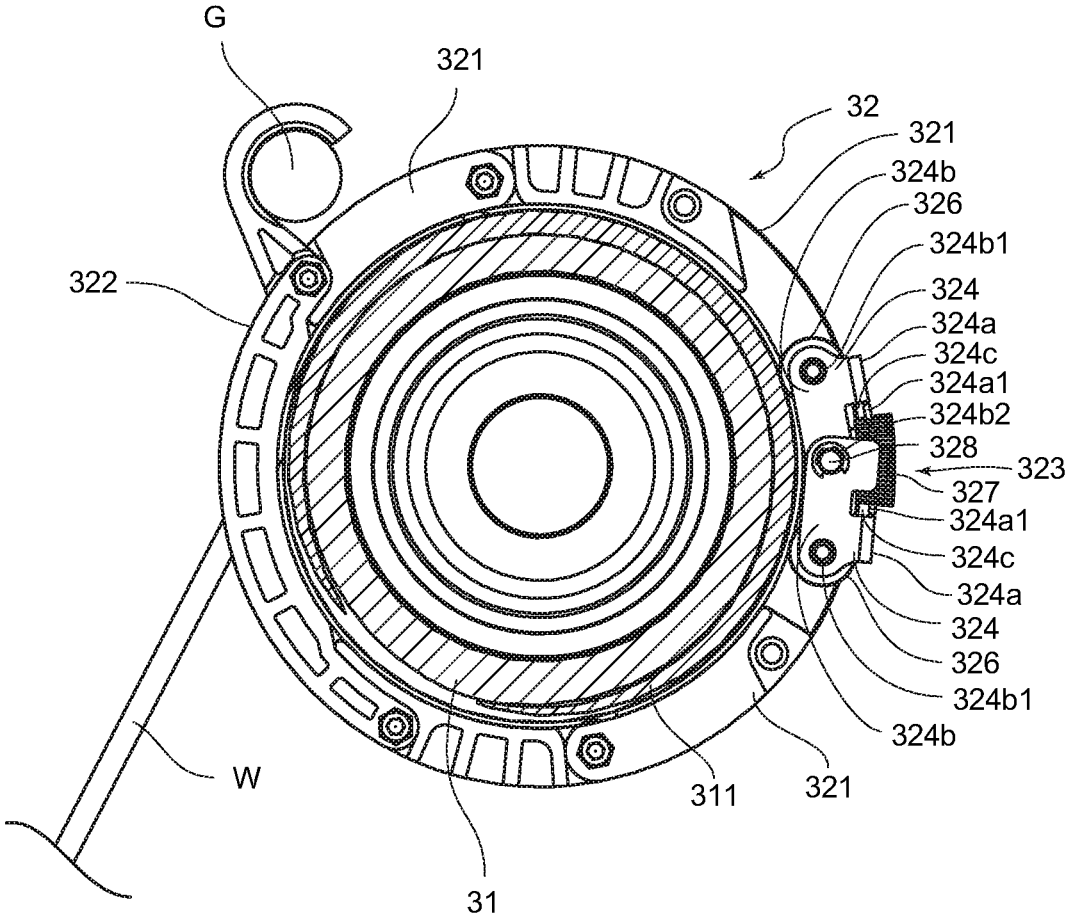
Fig.10
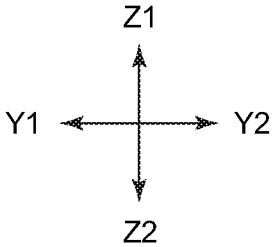

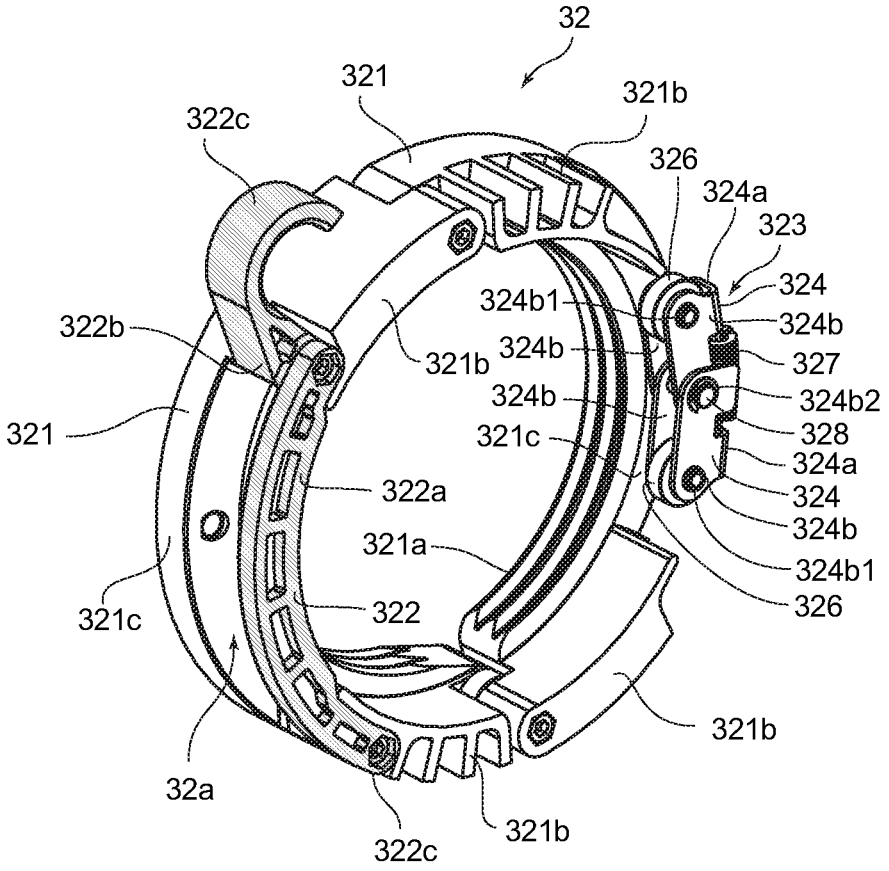
Fig.11
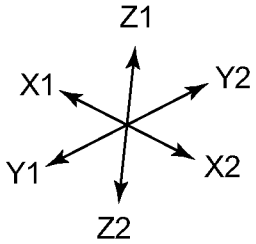

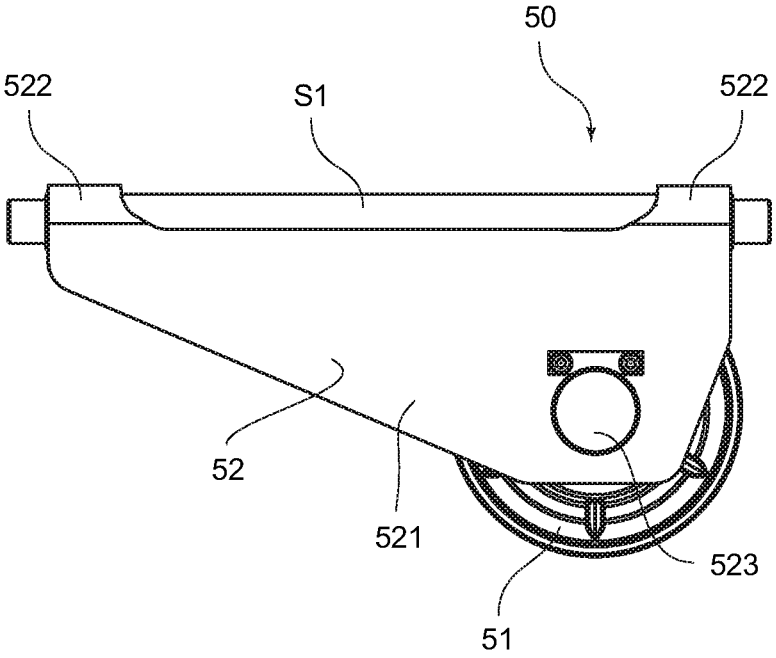
Fig.12
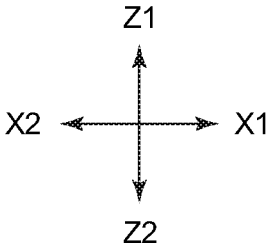

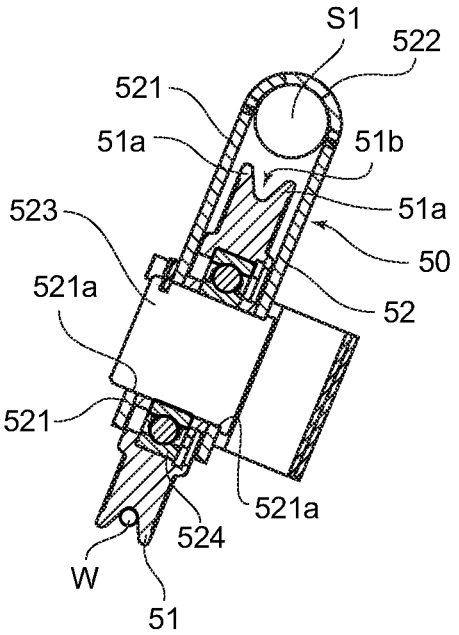
Fig.13
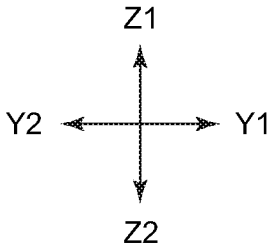

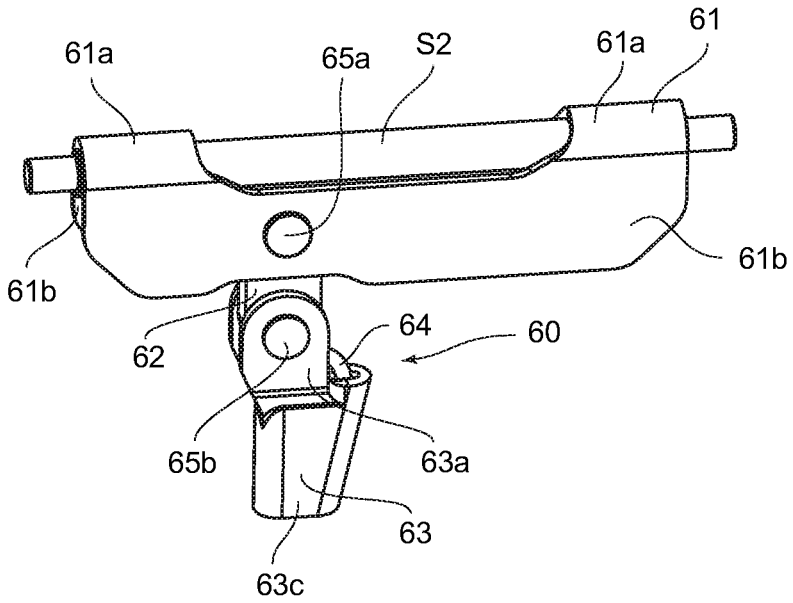
Fig.14
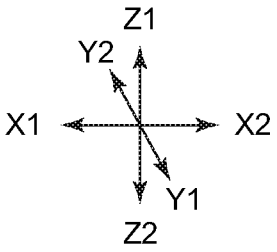

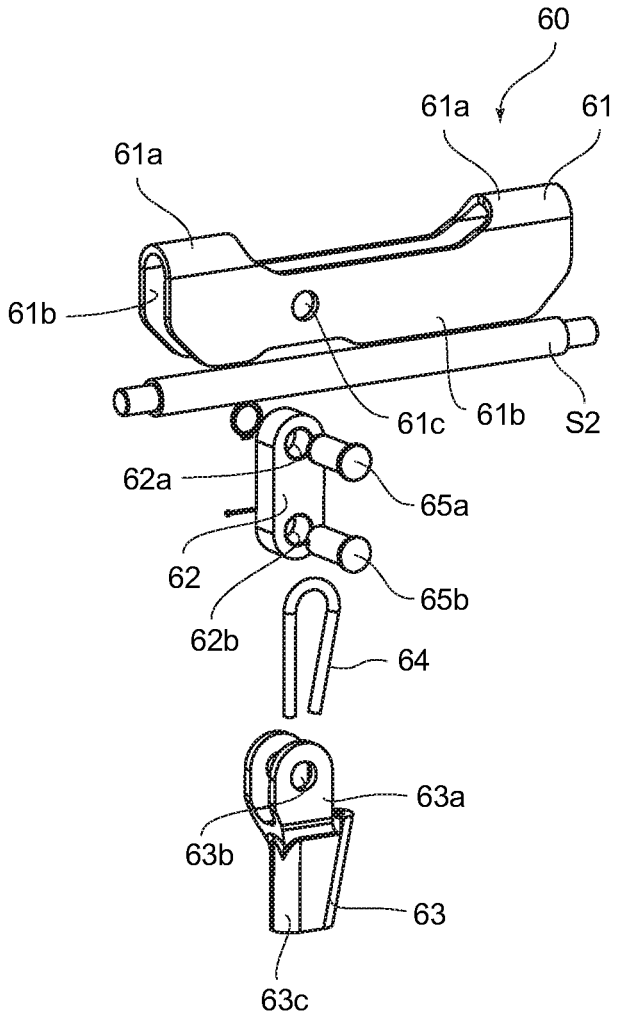
Fig.15
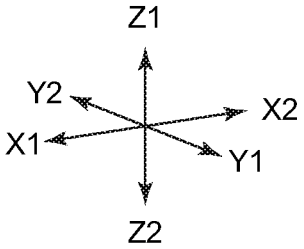

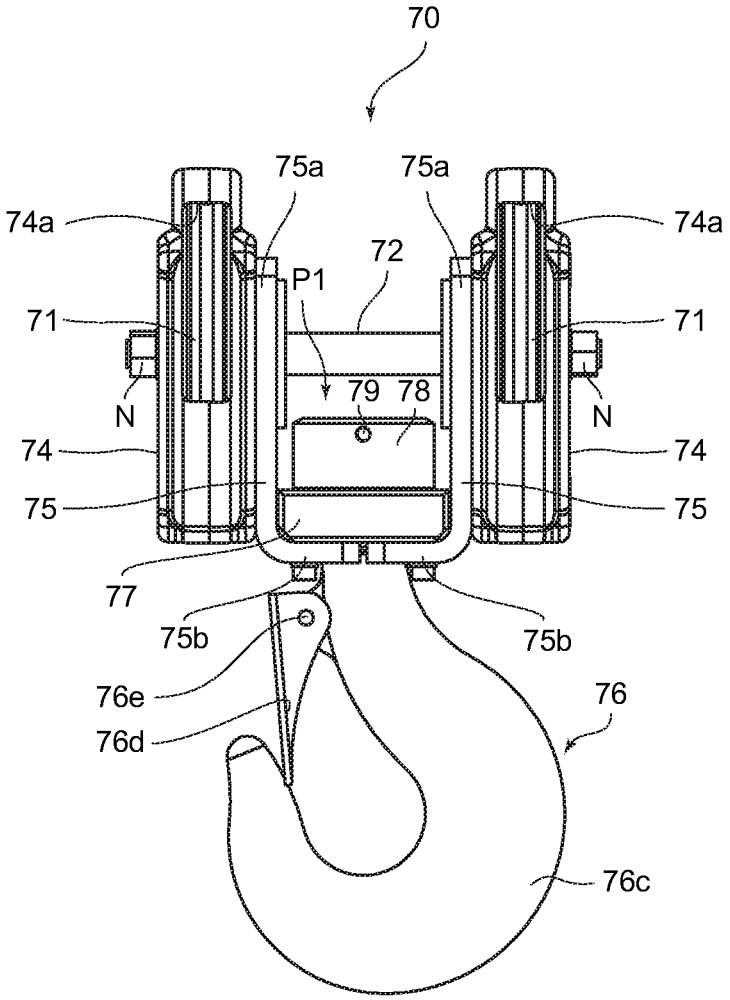
Fig.16
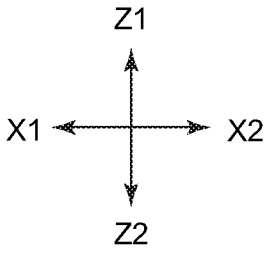

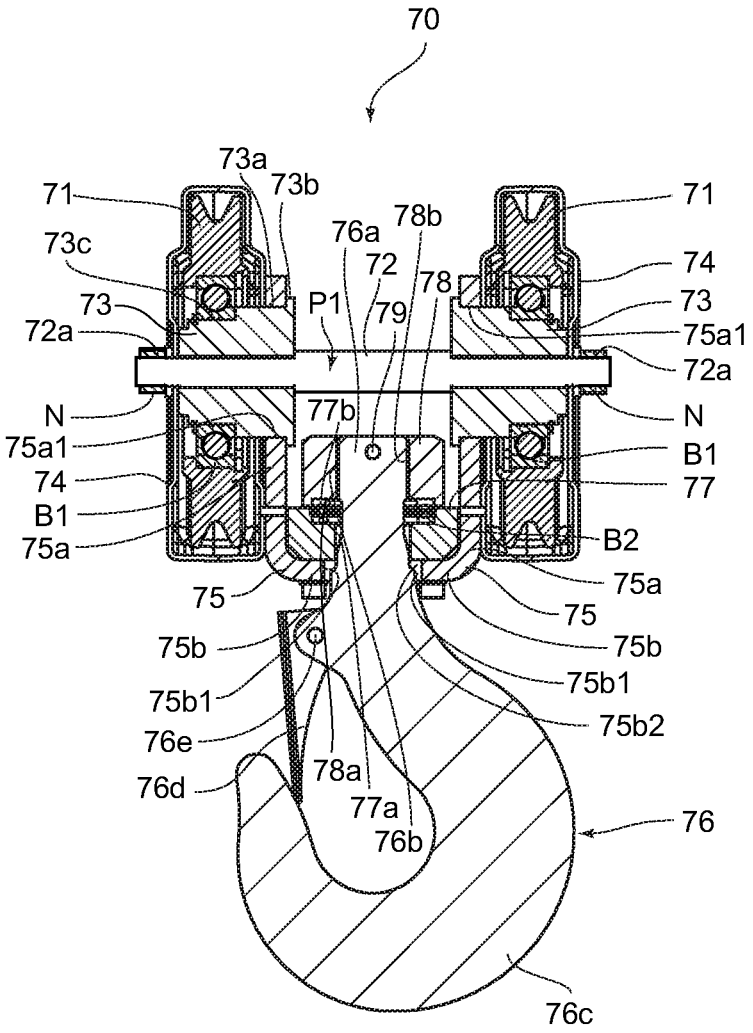
Fig.17
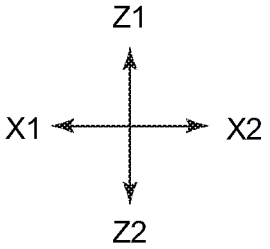

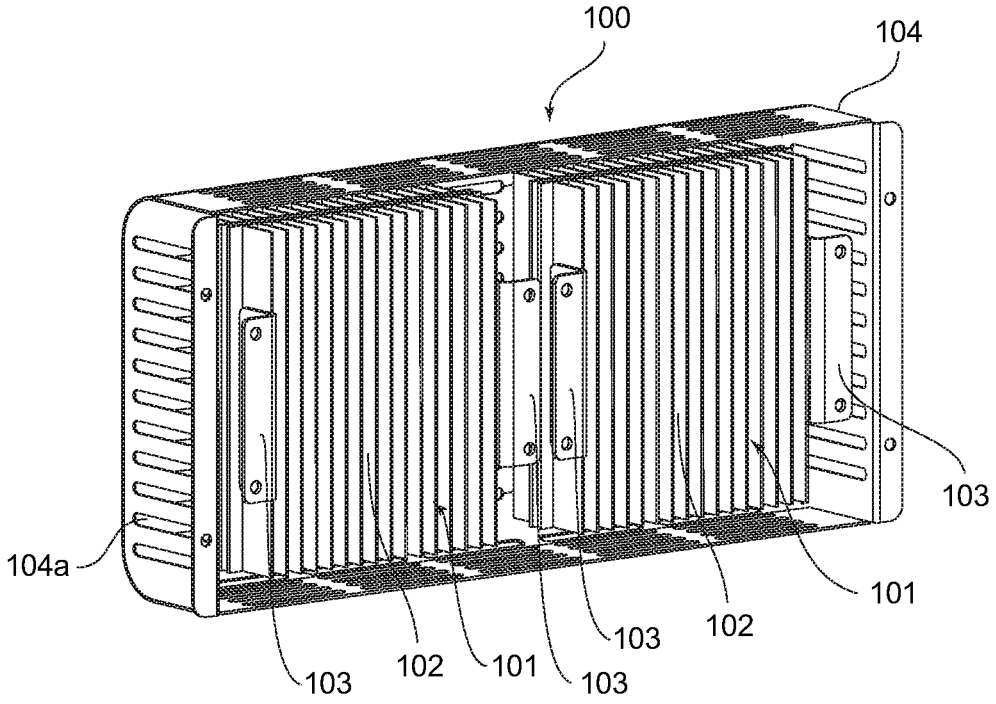
Fig.18
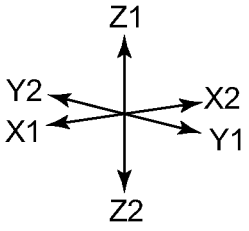

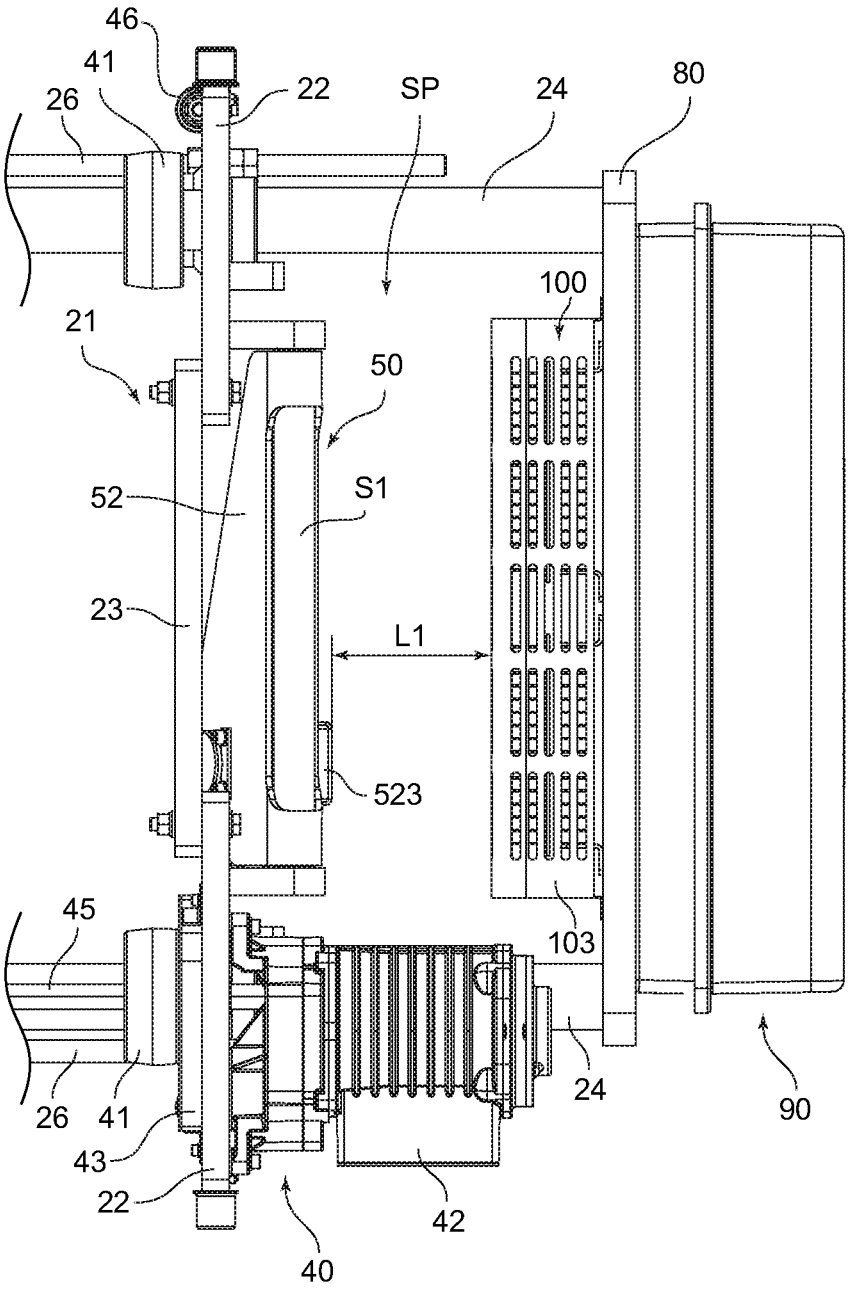
Fig.19
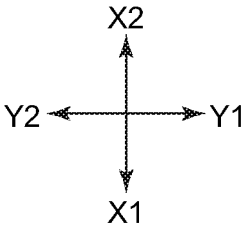

ROPE HOIST

This is the U.S. national stage of application No. PCT/JP2015/065661, filed on May 29, 2015. Priority under 35 U.S.C. § 119(a) and 35 U.S.C. § 365(b) is claimed from Japanese Application No. 2014-113376, filed May 30, 2014, the disclosure of which is also incorporated herein by reference.

TECHNICAL FIELD

The present invention relates to a rope hoist used for an operation of discharging a cargo.

BACKGROUND ART

To move a cargo in the vertical direction and move the suspended cargo along a rail laid on the ceiling side, a rope hoist is generally used. The rope hoist includes a rope drum around which a wire rope is to be wound, and the rope drum is rotated by a drum motor. The rope hoist also includes a trolley mechanism so as to move the cargo along the rail. The trolley mechanism includes a wheel in contact with a flange of the rail and includes a traversing motor that applies driving force to the wheel.

An example of the rope hoist includes, for example, the one disclosed in PTL 1.

CITATION LIST

{Patent Literature}

{PTL 1} JP 2013-511450A

SUMMARY OF INVENTION

Technical Problem

Incidentally, driving of the drum motor including the rope hoist as disclosed in PTL1 is often of a pole change type at present. However, the pole change type gives large impact when starting the drum motor, leading to a decrease in life of a driving portion such as gears and so on. Therefore, it is under discussion to perform inverter control capable of gradually starting and gradually stopping it.

Incidentally, in the conventional rope hoist, a control unit is generally attached in the vicinity in which the drum motor is located. Therefore, in the case of performing the inverter control, when the control unit is attached in the vicinity of the drum motor, it is also necessary to separately attach a braking resistor for exerting a regenerative braking ability. When the braking resistor is attached, the braking resistor projects out to increase the dimension of the rope hoist.

The present invention has been made based on the above circumstances, and its object is to provide a rope hoist which can be prevented from increasing in dimension even when a braking resistor is attached thereto.

Solution to Problem

To solve the above problem, according to a first aspect of the present invention, there is provided a rope hoist which enables movement along a rail direction by driving a wheel with respect to a rail, and hoists and lowers a cargo suspended therefrom via a wire rope by changing a winding length of the wire rope by rotation of a rope drum, the rope hoist including: a frame structure which rotatably supports the wheel; a rope drum mechanism which is provided on one side of the frame structure in a width direction orthogonal to the rail direction, and includes the rope drum and a drum motor which rotates the rope drum; a counterweight which is provided on another side of the frame structure in the width direction and is arranged in a state of having a space with respect to the frame structure; and a control unit which is attached to a side of the counterweight opposite to the rope drum mechanism in the width direction and inverter-controls the drum motor, wherein to the rope drum mechanism side of the counterweight, a braking resistor part which processes regenerative electric power in the inverter control is attached in a state of being located in the space.

Further, in another aspect of the present invention, it is preferable in the above invention that: the frame structure includes a pair of front-rear frames which are arranged along the rail direction and arranged to be separate from each other corresponding to a width of the rail and rotatably support the wheel, and a pair of coupling bars which extend along the width direction and couple the pair of front-rear frames; as the pair of front-rear frames, a drum-side frame located on the rope drum mechanism side and a weight-side frame located on the counterweight side are provided; the weight-side frame is fixed to the coupling bar via a fastening means, and is enabled to move with respect to the pair of coupling bars by releasing the fixation of the fastening means when the rope hoist is mounted on the rail; in the space, an intermediate sheave body is arranged which leads the wire rope to be wound around the rope drum to a hook sheave side; and when a case where the rope hoist is mounted on the rail having an assumed maximum width is regarded as a reference, a distance in the width direction between the braking resistor part and the intermediate sheave body in the space is set to be equal to or more than a distance obtained by adding twice the widths of a pair of wheels and a margin.

Further, in another aspect of the present invention, it is preferable in the above invention that the braking resistor part is provided at a position where the braking resistor part does not interfere, in a vertical direction, with the pair of coupling bars and a traversing motor which drives the wheel.

Further, in another aspect of the present invention, it is preferable in the above invention that a lower end side of the braking resistor part is located on an upper side than a lower end side of the counterweight, and the lower end side of the counterweight is provided at a position of height about equal to a lower end side of the rope drum mechanism.

Advantageous Effects of Invention

According to the present invention, it becomes possible to provide a rope hoist which can be prevented from increasing in dimension even when a braking resistor is attached thereto.

BRIEF DESCRIPTION OF DRAWINGS

FIG. 3 is a plan view illustrating the configuration of the rope hoist in FIG. 1 when viewed from the upper side;

FIG. 4 is a bottom view illustrating the configuration of the rope hoist in FIG. 1 when viewed from the lower side;

FIG. 6 is a rear view illustrating the configuration of the rope hoist in FIG. 1 when viewed from the rear side;

FIG. 9 is a partial side view of the rope drum for illustrating the vicinity of a rope guide mechanism in the rope hoist in FIG. 1;

FIG. 10 is a rear view illustrating a cross section of the rope drum in the rope hoist in FIG. 1 and illustrating the configuration of the rope guide mechanism;

FIG. 11 is a perspective view illustrating the configuration of the rope guide mechanism in the rope hoist in FIG. 1;

FIG. 12 is a partial cross-sectional view illustrating a state of an intermediate sheave body in the rope hoist in FIG. 1 when viewed from the side;

FIG. 13 is a front cross-sectional view illustrating the configuration of the intermediate sheave body in the rope hoist in FIG. 1;

FIG. 14 is a side view illustrating the configuration of a rope fixing member in the rope hoist in FIG. 1;

FIG. 15 is an exploded perspective view illustrating the configuration of the rope fixing member in the rope hoist in FIG. 1;

FIG. 16 is a side view illustrating the configuration of a hook block in the rope hoist in FIG. 1;

FIG. 17 is a side cross-sectional view illustrating the configuration of the hook block in the rope hoist in FIG. 1;

FIG. 18 is a perspective view illustrating the internal configuration of a braking resistor in the rope hoist in FIG. 1;

FIG. 19 is a plan view illustrating the appearance of the braking resistor of the rope hoist in FIG. 1 projecting to a space;

DESCRIPTION OF EMBODIMENTS

First Embodiment

Figure 1:
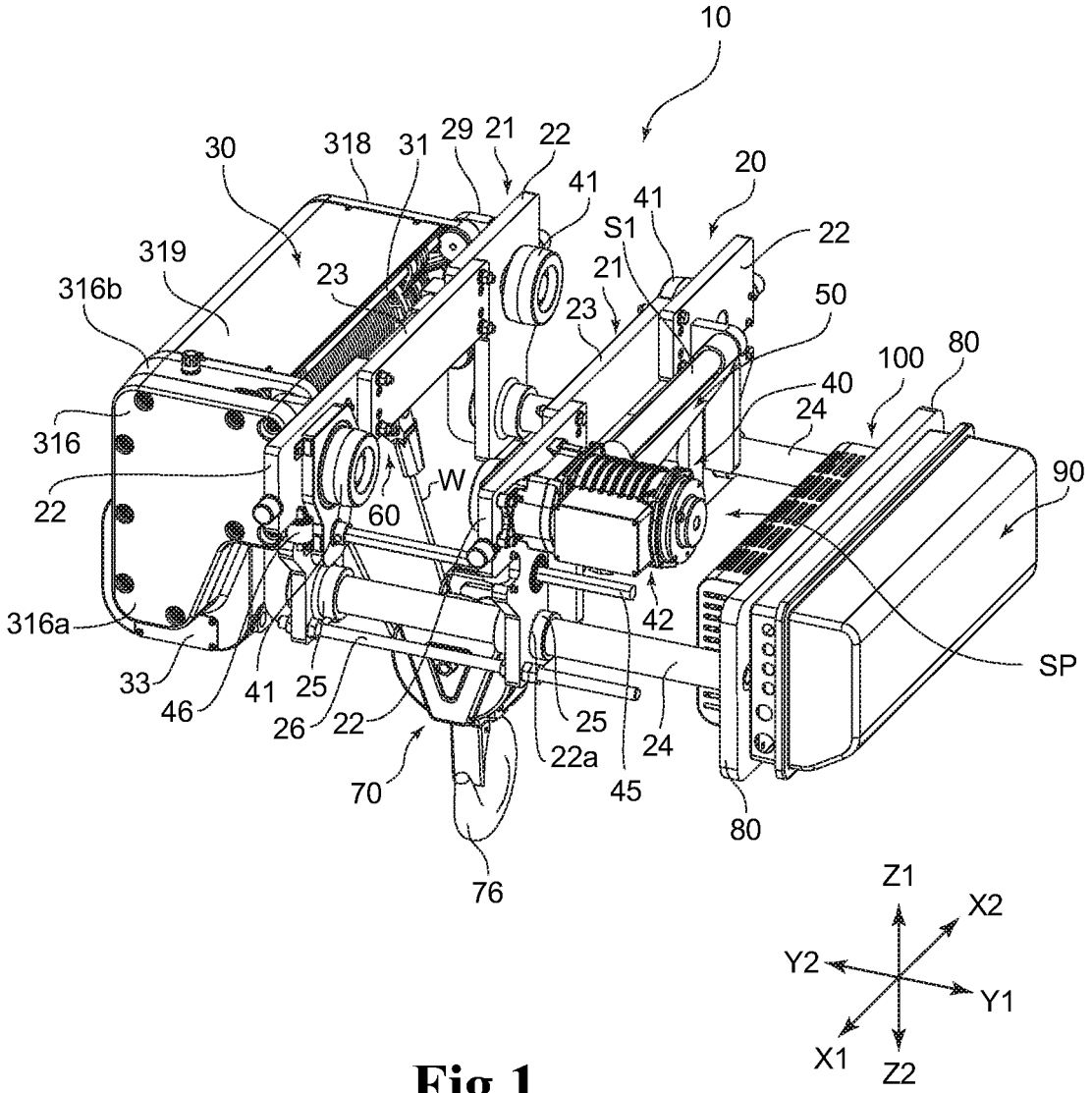
FIG. 1 is a perspective view illustrating the whole configuration of a rope hoist when viewed from the front side according to a first embodiment of the present invention.

Hereinafter, a rope hoist 10 according to a first embodiment of the present invention will be described based on the drawings. Note that in the following description, explanation will be given using an XYZ orthogonal coordinate system as necessary. An X-direction in the XYZ orthogonal coordinate system indicates a direction in which rails extend, an X1 side indicates a side where a drum motor 33 and a traversing motor 42 are located in a longitudinal direction of the rope hoist 10, and an X2 side indicates a side opposite thereto. A Z-direction indicates a vertical direction, a Z1 side indicates an upper side (namely, a side where rails R are located as viewed from a hook block 70), and a Z2 side indicates a lower side opposite thereto. Further, a Y-direction indicates a direction (a width direction of the rail R) orthogonal to the X-direction and the Z-direction, a Y1 side indicates a side where a trolley mechanism 40 is located as viewed from a rope drum mechanism 30, and a Y2 side indicates a side opposite thereto.

<1. Regarding the Whole Configuration of the Rope Hoist 10>

Figure 2:
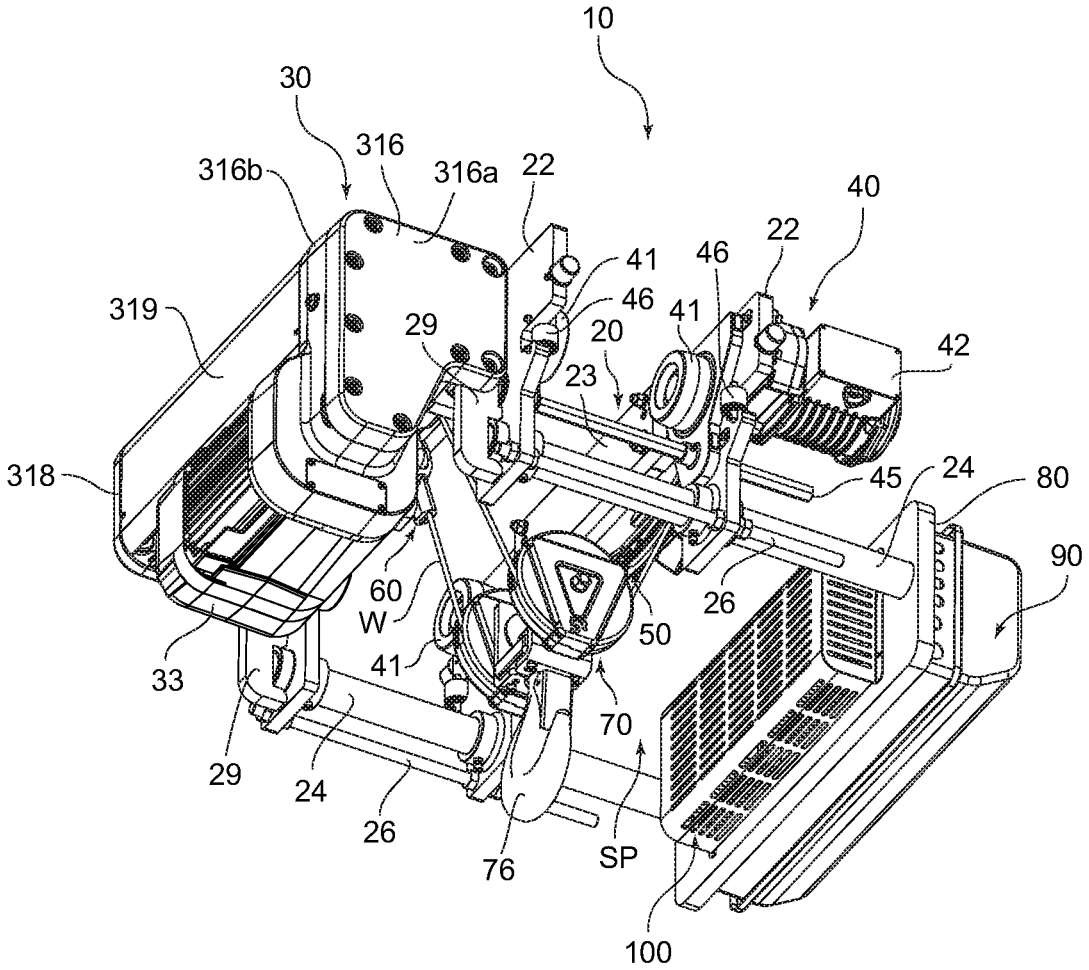
FIG. 2 is a perspective view illustrating the whole configuration of the rope hoist in FIG. 1 when viewed from the rear side.
Figure 2:
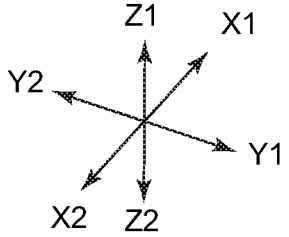
Figure 5:
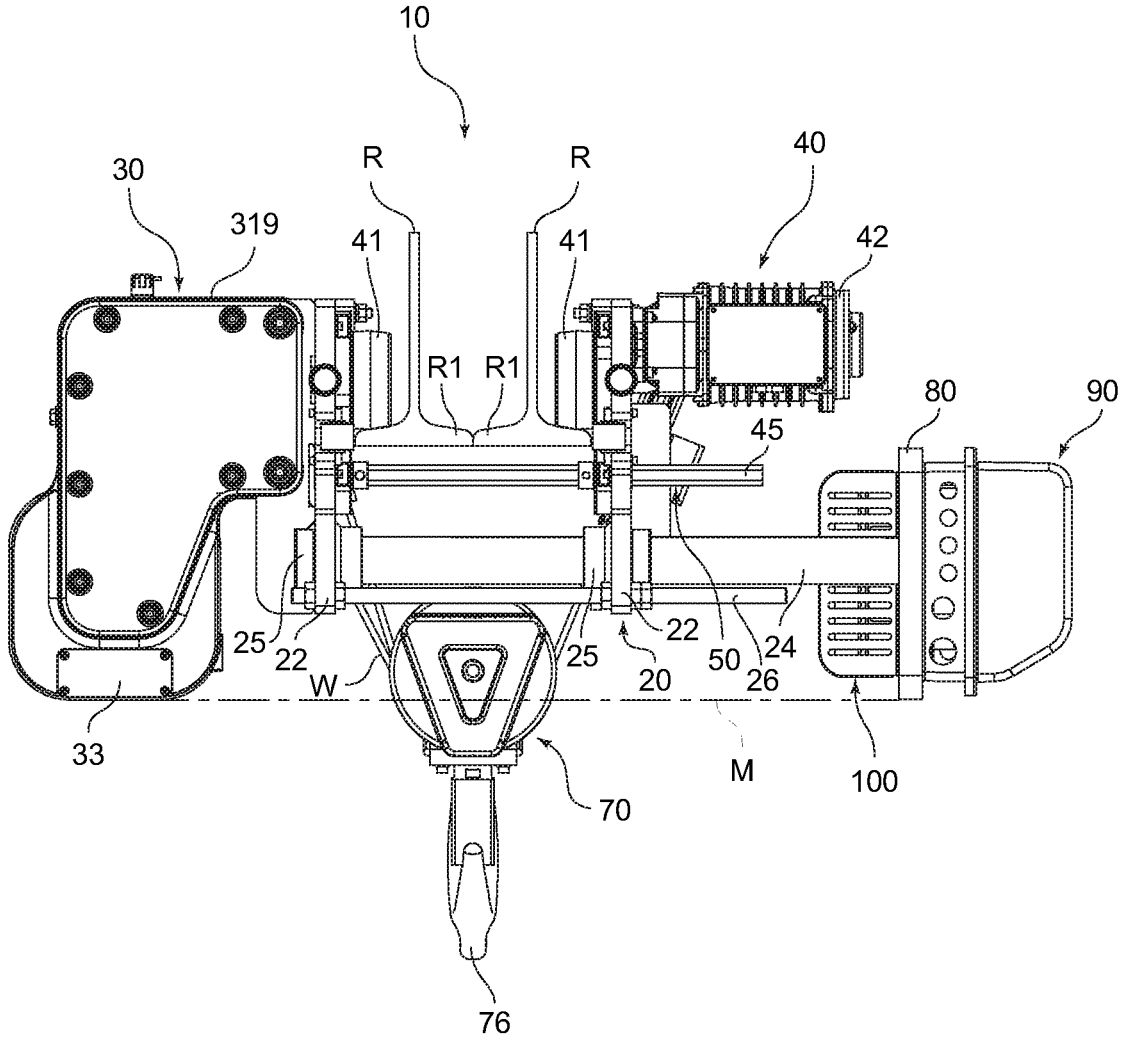
FIG. 5 is a front view illustrating the configuration of the rope hoist in FIG. 1 when viewed from the front side.
Figure 5:
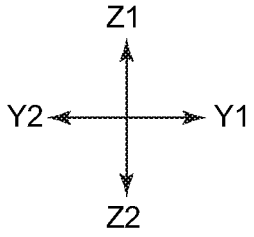

FIG. 1 is a perspective view illustrating the whole configuration of the rope hoist 10 when viewed from the front side. FIG. 2 is a perspective view illustrating the whole configuration of the rope hoist 10 when viewed from the rear side. FIG. 3 is a plan view illustrating the configuration of the rope hoist 10 when viewed from the upper side. FIG. 4 is a bottom view illustrating the configuration of the rope hoist 10 when viewed from the lower side. FIG. 5 is a front view illustrating the configuration of the rope hoist 10 when viewed from the front side. FIG. 6 is a rear view illustrating the configuration of the rope hoist 10 when viewed from the rear side.

As illustrated in FIG. 1 to FIG. 6, the rope hoist 10 includes a frame structure 20, the rope drum mechanism 30, the trolley mechanism 40, an intermediate sheave body 50, a rope fixing member 60, the hook block 70, a counterweight 80, a control unit 90, and a braking resistor 100.

<2. Regarding the Frame Structure 20>

Figure 7:
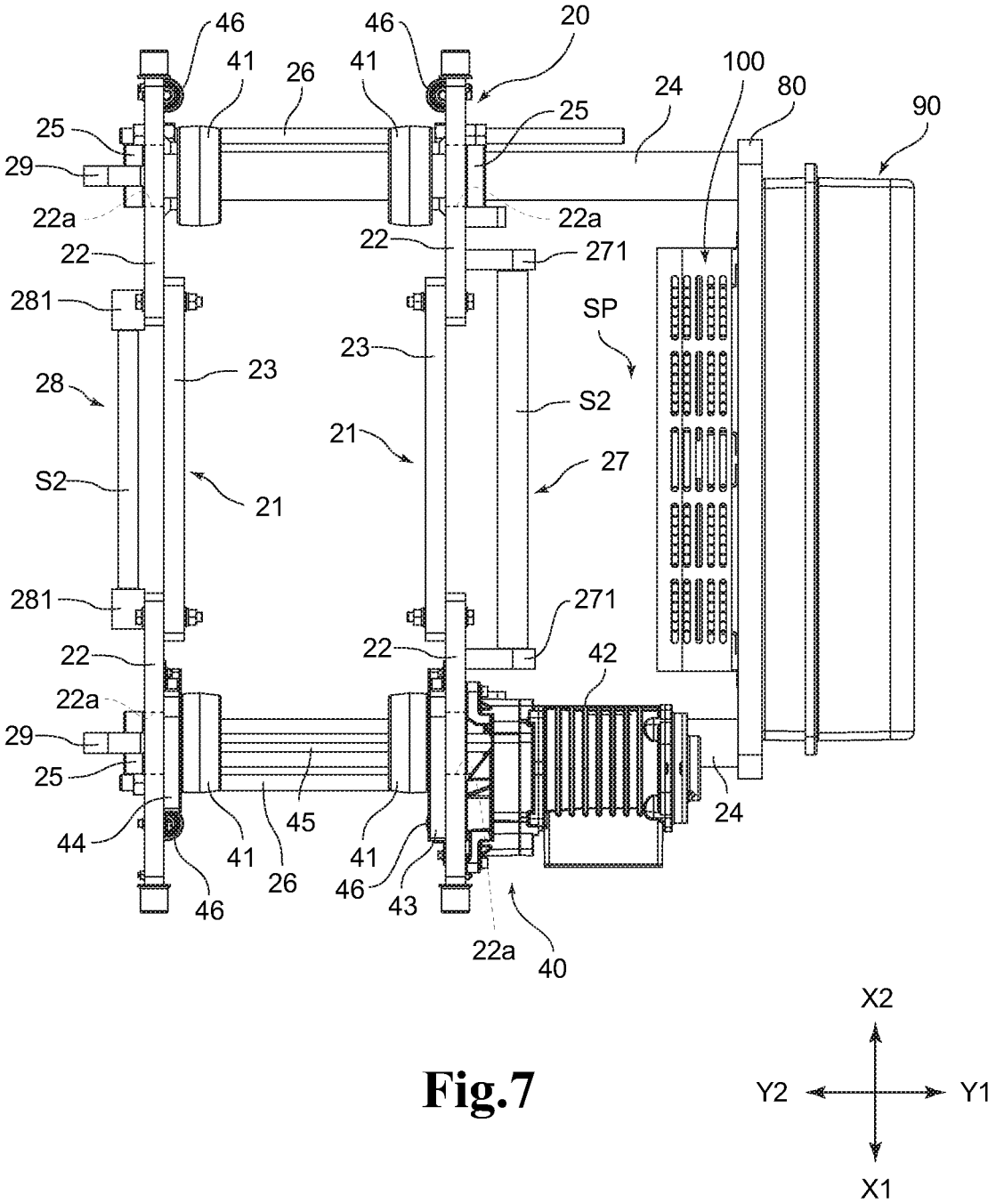
FIG. 7 is a plan view illustrating the configurations of a trolley mechanism and a frame structure in the rope hoist in FIG. 1.

The frame structure 20 will be described first. FIG. 7 is a plan view illustrating the configurations of the frame structure 20 and the trolley mechanism 40. As illustrated in FIG. 7, the frame structure 20 has a pair of front-rear frames 21, coupling bars 24, drum support frames 29, and attachment frames 271, which support the whole of the rope hoist 10.

The front-rear frames 21 are frames extending longitudinally in the extending direction (X-direction) of the rails R, and are provided on the right side and left side (the Y1 side and the Y2 side) across the rails R. The pair of front-rear frames 21 each have two support frames 22 and a coupling frame 23 connecting the support frames 22. To the support frame 22, various members including a wheel 41 are attached. Further, the support frame 22 is provided with an insertion hole 22*a*, a later-described mount member 25 is inserted into the insertion hole 22*a*.

To the support frame 22, the coupling frame 23 is coupled, for example, with a bolt or the like. In the configuration illustrated in FIG. 1 to FIG. 6, the coupling frame 23 is located between the two support frames 22 along the extending direction (X-direction) of the rail R. Note that the coupling frame 23 is located on the rail R side for effective use of a space located between the front-rear frames 21 facing each other in the Y-direction.

Note that the support frame 22 and the coupling frame 23 are provided in a state of not a thin plate but a thick plate so as to be able to support the various members including the wheel 41.

The frame structure 20 also has the coupling bars 24. The coupling bar 24 is a portion extending along the width direction (Y-direction). The coupling bar 24 is inserted into the above-described insertion hole 22*a* via the mount member 25 as illustrated in FIG. 1 and so on, and thereby attached to the support frame 22. Here, on another end side (Y2 side)

of the coupling bar 24, the other front-rear frame 21 (corresponding to a drum-side frame) of the pair of front-rear frames 21 is fixed. Further, at a middle portion of the coupling bar 24, the front-rear frame 21 on one side (corresponding to a weight-side frame) is fixed, and the counterweight 80 is fixed on the one end side (Y1 side) of the coupling bar 24.

Further, the mount member 25 is fixedly attached to the insertion hole 22*a*. Into the mount member 25, a fixing means such as a screw can be screwed, so that the screwing decides the position of the support frame 22 to the coupling bar 24. However, in this embodiment, the drum support frame 29 lies over an opening on the other end side (Y2 side) of the mount member 25 located on the other end side (Y2 side) in the width direction, whereby the coupling bar 24 bumps into the drum support frame 29 to thereby decide the position of the front-rear frame 21 on the other side (Y2 side) with respect to the coupling bar 24. However, loosening a fastening means such as a bolt makes it possible to freely change the front-rear frame 21 on the one side (Y1 side) with respect to the coupling bar 24. Thus, when mounting the rope hoist 10, the front-rear frame 21 on the one side (Y1 side) can be separated from the front-rear frame 21 on the other side (Y2 side).

Note that as illustrated in FIG. 6 and so on, the frame structure 20 is provided with coupling assist bars 26. The coupling assist bars 26 are threaded rods that adjust the positions of nuts to make it possible to adjust the position in the width direction (Y-direction) of the front-rear frame 21 on the one side (Y1 side) with respect to the front-rear frame 21 on the other side (Y2 side). In other words, in the case of mounting the rope hoist 10, the space between the pair of front-rear frames 21 is kept at a predetermined interval, the interval between the pair of front-rear frames 21 is adjusted to be appropriate after the mounting, and the interval is kept by fastening of the nuts or the like after the adjustment. In keeping the interval, for example, the front-rear frame 21 on the one side (Y1 side) can be fixed by fastening one nut to the surface on the other side (Y2 side) of the support frame 22, and fastening two nuts to the surface on the one side (Y1 side) of the support frame 22 (double nut).

Note that in the configuration illustrated in FIG. 7, to the frame structure 20, an intermediate sheave support part 27 and a terminal support part 28 are attached. The intermediate sheave support part 27 is a portion that supports a suspender shaft S1 supporting the later-described intermediate sheave body 50, and is arranged on the one side (Y1 side) in the width direction (Y-direction) of the frame structure 20 in the configuration illustrated in FIG. 7 and so on. To support the above-described suspender shaft S1, the intermediate sheave support part 27 has a pair of attachment frames 271, and the attachment frames 271 are attached to the pair of support frames 22 separated in the longitudinal direction (X-direction), respectively.

Because the intermediate sheave support part 27 is arranged on the one side (Y1 side) in the width direction (Y-direction) of the frame structure 20 as described above, the attachment frames 271 project toward the one side (Y1 side) in the width direction (Y-direction). Therefore, a space SP between the frame structure 20 and the later-described counterweight 80 is narrowed by an amount corresponding to the existence of the attachment frames 271 and the intermediate sheave body 50.

Besides, the terminal support part 28 is a portion that supports a terminal support shaft S2 supporting the later-described rope fixing member 60, and is arranged on the other side (Y2 side) in the width direction (Y-direction) of the frame structure 20 in the configuration illustrated in FIG. 7 and so on. The terminal support part 28 has a pair of shaft holding parts 281, and the shaft holding parts 281 are attached to the pair of support frames 22 separated in the longitudinal direction (X-direction), respectively.

Further, the frame structure 20 is provided with the drum support frame 29 projecting toward the other side (Y2 side) in the width direction (Y-direction). A pair of the drum support frames 29 are provided, and the drum support frames 29 are attached to the support frames 22 separated in the longitudinal direction (X-direction), respectively. To the pair of drum support frames 29, one end side and the other end side of the rope drum mechanism 30 described next are fixed, respectively.

<3. Regarding the Rope Drum Mechanism 30>

Next, the rope drum mechanism 30 will be described. As illustrated in FIG. 1 to FIG. 6 and so on, the rope drum mechanism 30 has a rope drum 31, a rope guide mechanism 32, the drum motor 33, and a reduction mechanism 34 as main components.

Figure 8:
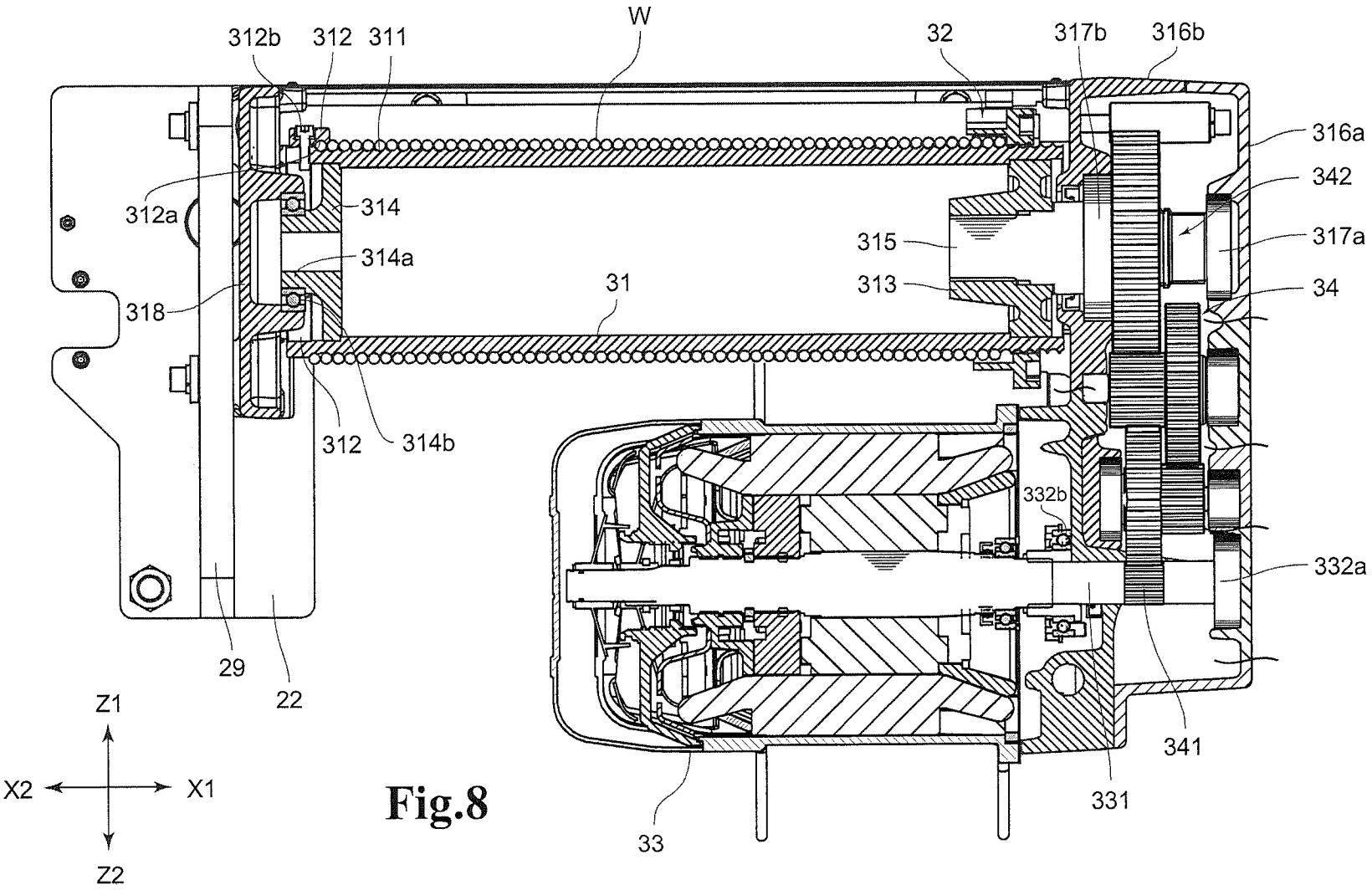
FIG. 8 is a side view illustrating the configuration of a rope drum in the rope hoist in FIG. 1, and illustrating the vicinity of the rope drum and the vicinity of a drum motor in a cross section.

FIG. 8 is a side view illustrating the configuration of the rope drum 31, and illustrating the vicinity of the rope drum 31 and the vicinity of the drum motor 33 in a cross section. As illustrated in FIG. 8, the rope drum 31 is a drum-shaped member around which a wire rope W is wound, and is formed, on the outer peripheral side, with a spiral groove 311 in a recessed groove shape in which the wore rope W is fitted. The spiral groove 311 is formed in a spiral shape on the outer periphery of the rope drum 31, and formed corresponding to the radius of the wire rope W. Further, the spiral groove 311 is formed such that the wire rope W is lined up thereon in a row in a not-overlapping state (in a single layer state).

Note that to the other end side (rear side; X2 side) of the rope drum 31, a rope pressing metal fitting 312 for fixing the one end side of the wire rope W is attached. The rope pressing metal fitting 312 includes a recessed part 312*a* where the wire rope W is located, and a screw 312*b* being a fastening means is firmly screwed into the rope drum 31 with the wire rope W located in the recessed part 312*a*. Thus, the one end side of the wire rope W is fixed to the rope drum 31.

Further, to the one end side (front side; X1 side) and the other end side (rear side; X2 side) of the rope drum 31, rotatable support parts 313, 314 are attached, respectively. As illustrated in FIG. 8, to the rotatable support part 313 on the one end side (front side; X1 side), a drum rotation shaft 315 is coupled, for example, by spline coupling. The drum rotation shaft 315 is attached to a pair of gear housings 316*a*, 316*b* via bearings 317*a*, 317*b* as shaft bearings. Note that in this embodiment, the gear housings 316*a*, 316*b* are formed in different shapes, and the bearings 317*a*, 317*b* are also of different types, but the gear housings 316*a*, 316*b* or the bearings 317*a*, 317*b* may be made common.

Besides, to an annular projecting part 314*a* on the center side in the radial direction of the rotatable support part 314 on the other end side (rear side; X2 side) of the rope drum 31, a bearing 314*b* is attached, and the outer peripheral side of the bearing 314*b* is attached to an attachment frame 318. Thus, the other end side of the rope drum 31 is also rotatably supported. Note that as illustrated in FIG. 1 and so on, the rope drum 31 is covered, on the upper side, with a cover frame 319.

FIG. 9 is a partial side view of the rope drum 31 for illustrating the vicinity of the rope guide mechanism 32. FIG. 10 is a rear view illustrating a cross section of the rope drum 31 and illustrating the configuration of the rope guide mechanism 32. FIG. 11 is a perspective view illustrating the configuration of the rope guide mechanism 32. As illustrated in FIG. 9 and FIG. 10, the rope guide mechanism 32 is a member that moves in a front-rear direction (X-direction) while being guided by a support shaft G with the rotation of the rope drum 31. Note that the support shaft G is supported by the above-described gear housing 316*a* and attachment frame 318 and can satisfactorily guide the slide of the rope guide mechanism 32. Note that a plurality of, such as, three support shafts G are provided. Besides, the plurality of support shafts G are attached to the gear housing 316*a* and the attachment frame 318, thereby constituting a drum support structure that supports the rope drum 31.

As illustrated in FIG. 9 to FIG. 11, the rope guide mechanism 32 has a ring-shaped member 321, a guide member 322, and a guide roller body 323 as main components.

As illustrated in FIG. 11, the ring-shaped member 321 is a member formed into a ring shape by combining a plurality of, such as, two circumferential members and the guide member 322. On the inner peripheral side of the ring-shaped member 321, a spiral projecting part 321*a* is provided which is fitted in the spiral groove 311 of the rope drum 31. The spiral projecting part 321*a* is provided in a circumferential shape forming a spiral. However, to prevent interference with the rope drum 31, the spiral projecting part 321*a* is provided on the inner peripheral side of the ring-shaped member 321 to face a non-wound side of the wire rope W.

Besides, as illustrated in FIG. 11, both end sides in the circumferential direction of the ring-shaped member 321 are provided widely by providing projecting parts 321*b* projecting to the other side (X2 side) in the X-direction. However, a portion located between the projecting parts 321*b* on both ends in the circumferential direction is a narrow-width part 321*c* with a narrow width. Further, to the narrow-width part 321*c* of one ring-shaped member 321, the guide member 322 is fixed. Thus, between the ring-shaped member 321 and the guide member 322, a guide opening 32*a* that guides the wire rope W is provided. Note that the guide opening 32*a* is an opening portion for leading the wire rope W to be wound around the rope drum 31 while guiding the wire rope W to the spiral groove 311, and is provided in a long-hole opening shape.

Further, as illustrated in FIG. 11, the guide member 322 is attached to the narrow-width part 321*c* of the ring-shaped member 321 via a screw or the like. The guide member 322 is provided with an arc-shaped part 322*a*, coupling parts 322*b*, and a guide part 322*c*. The arc-shaped part 322*a* is provided in an arc shape to follow the outer periphery of the rope drum 31. Besides, the coupling parts 322*b* are portions that are located on both end sides of the arc-shaped part 322*a* and abut on the narrow-width part 321*c*. To be able to abut on the narrow-width part 321*c*, the coupling parts 322*b* are provided larger in dimension in the width direction (X-direction) than the arc-shaped part 322*a*.

Further, the guide part 322*c* is provided in a curved hook shape, and is in contact with the support shaft G at a recessed part 321*c*1 being the inside of the curve. The support shaft G is fitted in the recessed part 321*c*1 and thereby makes the rope guide mechanism 32 satisfactorily movable in the front-rear direction (X-direction).

Besides, as illustrated in FIG. 10 and FIG. 11, the guide roller body 323 is attached to the narrow-width part 321*c* of the other ring-shaped member 321. The guide roller body 323 has a pair of roller supporters 324, rollers 326, a biasing spring 327, and an attaching shaft 328. The rollers 326 press the wire rope W fitted in the spiral groove 311 after passing through the guide opening 32*a*, and thereby prevent the wire rope W from coming off the spiral groove 311.

The roller supporters 324 of the guide roller body 323 each have a base part 324*a* and a pair of opposing wall parts 324*b*, which form an almost U-shape. However, one of the pair of roller supporters 324 is provided wider than the other of the roller supporters 324, so that the other roller supporter 324 can be located inside the one roller supporter 324. The two roller supporters 324 are coupled together via the attaching shaft 328.

On the base parts 324*a*, end portion sides of the biasing spring 327 are supported, respectively. Therefore, the length of the base part 324*a* is provided shorter than the length of the opposing wall parts 324*b* so that the biasing spring 327 can be located between the two base parts 324*a*, thereby forming opening 324*c* between the two base parts 324*a*.

Further, from the base parts 324*a*, rod parts 324*a*1 project toward the opening 324*c*, and the rod parts 324*a*1 are inserted into air-core portions of the biasing spring 327. Thus, the biasing spring 327 is supported between the two base parts 324*a*. Note that the biasing spring 327 is a compression spring, and applies biasing force to the rollers 326 in a direction of pressing the wire rope W against the spiral groove 311.

Besides, the opposing wall parts 324*b* are provided with shaft holes 324*b*1, and the support shaft for the roller 326 is rotatably supported by the shaft holes 324*b*1. The opposing wall parts 324*b* are also provided with coupling holes 324*b*2 for coupling the two roller supporters 324. The coupling holes 324*b*2 of the roller supporter 324 located on the outside and the coupling holes 324*b*2 of the roller supporter 324 located on the inside are aligned, and the attaching shaft 328 is inserted through the coupling holes 324*b*2. Further, at the narrow-width part 321*c* of the other ring-shaped member 321, the attaching shaft 328 is coupled to the ring-shaped member 321. Thus, the roller supporters 324 are attached to the ring-shaped member 321 via the attaching shaft 328.

The above configuration of the rope guide mechanism 32 enables the wire rope W to fit into the spiral groove 311 of the rope drum 31 via the guide opening 32*a*. It is also possible to lead the wire rope W out of the spiral groove 311 to the outside via the guide opening 32*a*. In this event, the provision of the guide roller body 323 on the opposite side in the circumferential direction to the guide opening 32*a* prevents the wire rope W from coming off the spiral groove 311.

Besides, as illustrated in FIG. 8, to the gear housings 316*a*, 316*b*, the drum motor 33 is attached. The drum motor 33 applies driving force of rotating the rope drum 31. To an output shaft 331 of the drum motor 33, a pinion gear 341 constituting the reduction mechanism 34 is attached, and driving force of the pinion gear 341 is transmitted through a gear train wheel 342 to the drum rotation shaft 315. Note that the output shaft 331 is also attached to the gear housings 316*a*, 316*b* via bearings 332*a*, 332*b* as shaft bearings. Hereinafter, when the gear housings 316*a*, 316*b* are collectively described, they are called simply as a gear housing 316.

<4. Regarding the Trolley Mechanism 40>

Next, the trolley mechanism 40 will be described. As illustrated in FIG. 1 to FIG. 6 and so on, the rope hoist 10 has the trolley mechanism 40. The trolley mechanism 40 has the wheels 41 attached to the support frames 22 of the frame structure 20, the traversing motor 42, gear mechanism parts 43, 44, a drive shaft 45, and guide rollers 46. Note that the frame structure 20 may also be the one constituting the trolley mechanism 40. Two wheels 41 each on one side and the other side of the rails R (four in total) are provided. The wheels 41 are mounted on flange parts R1 of the rails R.

As illustrated in FIG. 7, to the support frame 22 located on the one side (Y1 side) in the width direction, the traversing motor 42 that generates driving force is attached. The traversing motor 42 applies the driving force to the two wheels 41 located on the one side (X1 side) in the longitudinal direction (X-direction). In more detail, the driving force from the output shaft of the traversing motor 42 is transmitted to the drive shaft 45 through a gear train wheel (not illustrated) located inside the gear mechanism part 43.

The drive shaft 45 is provided along the width direction (Y-direction), and its other end side (Y2 side) in the width direction (Y-direction) is connected to the gear mechanism part 44. Also inside the gear mechanism part 44, a gear train wheel (not illustrated) is provided, and the driving force is transmitted through the gear train wheel to the wheels 41 on the other end side (Y2 side). Thus, the two wheels 41 are simultaneously rotated to enable stable traveling of the rope hoist 10.

Note that to the support frames 22, the guide rollers 46 are attached respectively. When the traversing motor 42 is driven to move the rope hoist 10 along the rails R, the rope hoist 10 meanders in some cases. To prevent such meander, the guide rollers 46 are provided in the vicinity of the respective wheels 41, and the guide rollers 46 are in contact with the flange parts R1 of the rails R. This stabilizes the traveling of the rope hoist 10. The guide rollers 46 are located on a slightly lower side than are the wheels 41 so as to come into contact with the flange parts R1, and are provided on an outer side in the longitudinal direction (X-direction) than are the wheels 41.

<5. Regarding the Intermediate Sheave Body 50>

Next, the intermediate sheave body 50 will be described. As illustrated in FIG. 3 and FIG. 6, the intermediate sheave body 50 is provided on a side more rear (X2 side) than is the traversing motor 42. FIG. 12 is a partial cross-sectional view illustrating a state of the intermediate sheave body 50 as viewed from the side. Besides, FIG. 13 is a front cross-sectional view illustrating the configuration of the intermediate sheave body 50.

As illustrated in FIG. 12, the intermediate sheave body 50 includes an intermediate sheave 51 (pulley) around which the wire rope W is wound, and the intermediate sheave 51 has a recessed groove 51*b* surrounded by a flange 51*a*. Further, the intermediate sheave 51 is arranged in a direction to be parallel with the rails R. The intermediate sheave body 50 enables relay of the wire rope W between adjacent hook sheaves 71 (refer to FIG. 16, FIG. 17) of the later-described hook block 70. The intermediate sheave body 50 is attached to the suspender shaft S1. The intermediate sheave body 50 includes a suspending metal fitting 52, and the suspending metal fitting 52 is supported on the suspender shaft S1.

As illustrated in FIG. 11 and FIG. 12, the suspending metal fitting 52 has a pair of plate portions 521 facing each other, and coupling portions 522 that couple the pair of plate portions 521 are provided on both end sides and an upper side of the plate portions 521. As illustrated in FIG. 12, the coupling portions 522 are provided in a shape curved to surround the suspender shaft S1, and the coupling portions 522 swing (turn) in contact with the suspender shaft S1 and thereby enable the intermediate sheave body 50 to swing (turn over). Note that a portion between the pair of coupling portions 522 is a punched portion P.

Between the pair of plate portions 521, the intermediate sheave 51 is rotatably supported. More specifically, the pair of plate portions 521 are provided with rotatable support holes 521*a* respectively, and to the rotatable support holes 521*a*, a support shaft 523 is attached. On the outer peripheral side of the support shaft 523 and between the pair of plate portions 521, a bearing 524 as a shaft bearing is attached. To the outer peripheral side of the bearing 524, the intermediate sheave 51 is attached. Thus, the intermediate sheave 51 is provided rotatably with respect to the plate portions 521.

<6. Regarding the Rope Fixing Member 60>

Besides, as illustrated in FIG. 1 to FIG. 4 and so on, to retain the one end side of the wire rope W, the rope fixing member 60 is provided. The rope fixing member 60 is attached to the above-described terminal support shaft S2. FIG. 14 is a side view illustrating the configuration of the rope fixing member 60. FIG. 15 is an exploded perspective view illustrating the configuration of the rope fixing member 60. As illustrated in FIG. 14 and FIG. 15, the rope fixing member 60 has a horizontal turn metal fitting 61, a connecting member 62, a vertical turn metal fitting 63, and a wedge member 64 as main components. The horizontal turn metal fitting 61 is provided having a front shape in an almost U-shape, and curved portions 61*a* in an almost U shape are in contact with the terminal support shaft S2, and plate portions 61*b* continuing to the curved portions 61*a* face each other. The slide between the curved portions 61*a* and the terminal support shaft S2 enables the horizontal turn metal fitting 61 to swing in a YZ plane.

The pair of plate portions 61*b* of the horizontal turn metal fitting 61 are provided with shaft holes 61*c*. Further, between the pair of plate portions 61*b*, the connecting member 62 is arranged. Further, on an upper side of the connecting member 62, a through hole 62*a* is provided into which a fixing shaft 65*a* is to be inserted. Therefore, the shaft holes 61*c* and the through hole 62*a* are aligned and the fixing shaft 65*a* is inserted into them, whereby the connecting member 62 is provided to be swingable within a plane including the extending direction of the rails R via the fixing shaft 65*a*.

Further, also on an upper side of the vertical turn metal fitting 63, a pair of plate portions 63*a* are provided, and a lower side of the connecting member 62 is arranged between the pair of plate portions 63*a*. Here, the pair of plate portions 63*a* are provided with shaft holes 63*b* respectively. Further, also on a lower side of the connecting member 62, a through hole 62*b* is provided. Therefore, the shaft holes 63*b* and the through hole 62*b* are aligned and a fixing shaft 65*b* is inserted into them, whereby the vertical turn metal fitting 63 is provided to be swingable within a plane including the extending direction of the rails R via the connecting member 62.

Further, on a lower side of the vertical turn metal fitting 63, a rope retaining part 63*c* is provided. The rope retaining part 63*c* is provided such that the upper side and the lower side of a quadrangular pyramid columnar shape are opened to allow the wire rope W and the later-described wedge member 64 to be inserted thereinto from the upper side and the lower side. Further, the rope retaining part 63*c* is provided such that its cross-sectional area becomes smaller downward.

As illustrated in FIG. 14 and FIG. 15, inside the rope retaining part 63*c*, the wedge member 64 is arranged. The wedge member 64, in the configuration illustrated in FIG. 15, is formed by curving a rod-shaped member such as a steel bar (wire material) with a predetermined diameter. The wedge member 64 is provided such that a curved portion has a large diameter on the upper side, and rod-shaped members become closer to each other toward the lower side. Further, on the outer peripheral side of the wedge member 64, the wire rope W is provided to go around. Therefore, the wire rope W is sandwiched between the wedge member 64 and the inner wall of the rope retaining part 63*c*, and the other end side of the wire rope W is fixed by wedging. In particular, when a large load acts on the wire rope W, the wedge member 64 tries to move downward. In this case, the wire rope W is held by large holding force between the wedge member 64 and the inner wall of the rope retaining part 63*c*. This restricts downward movement of the wire rope W.

Note that the most terminal side of the wire rope W is fixed to a middle portion of the wire rope W by a not-illustrated fixing metal fitting below the rope retaining part 63*c*.

<7. Regarding the hook block 70>

Next, the hook block 70 will be described. As illustrated in FIG. 1 to FIG. 6, the rope hoist 10 includes the hook block 70. The hook block 70 is suspended at a middle portion between the one end side and the other end side of the wire rope W.

FIG. 16 is a side view illustrating the configuration of the hook block 70. Besides, FIG. 17 is a side cross-sectional view illustrating the configuration of the hook block 70. As illustrated in FIG. 16 and FIG. 17, the hook block 70 has a pair of hook sheaves 71, and the hook sheaves 71 are attached by shaft bearings B1 to sheave shaft parts 73 attached to a coupling shaft 72.

On the outer periphery of the sheave shaft part 73, a bracket support part 73*a*, a flange part 73*b*, and a shaft bearing support part 73*c* are provided. The bracket support part 73*a* is a portion to which the later-described bracket 75 is attached, is inserted in a support hole 75*a*1, and is provided to be smaller in diameter than the flange part 73*b*. Therefore, the flange part 73*b* cannot be inserted through the support hole 75*a*1 but is locked on its outer peripheral side. Further, the shaft bearing support part 73*c* is provided to be smaller in diameter than the bracket support part 73*a*, and the shaft bearing B1 is arranged on its outer peripheral side. On the outer peripheral side of the shaft bearing B1, the hook sheave 71 is attached, whereby the hook sheave 71 is supported to be rotatable with respect to the coupling shaft 72.

The hook sheave 71 is a pulley around which the wire rope W is to be wound, and the most en of the outer peripheral side of the hook sheave 71 is covered with the cover 74 for preventing entangling of a foreign substance. Note that the cover 74 is provided with an opening part 74*a* for leading the wire rope W out as illustrated in FIG. 16. Note that the coupling shaft 72 projects to the outside through the covers 74, the projecting portions are provided with thread parts 72*a*, and nuts N are screwed onto the thread parts 72*a* to fix the positions in the axial direction of the sheave shaft parts 73, the covers 74, and the hook sheaves 71.

To support the above-described sheave shaft parts 73, a pair of brackets 75 are provided. In the configuration illustrated in FIG. 16 and FIG. 17, the bracket 75 is provided having an external appearance in an almost L-shape. A long piece part 75*a* of the L-shape is provided with the support hole 75*a*1 through which the above-described sheave shaft part 73 is to be inserted. Further, a short piece part 75*b* orthogonal to the long piece part 75*a* is arranged in a state of facing the short piece part 75*b* of the other bracket 75. Thus, a housing space P1 surrounded by the long piece parts 75*a* and the short piece parts 75*b* is formed.

Further, on tip end sides facing each other of the short piece parts 75*b*, half-shaped opening 75*b*1 are provided, and two opening 75*b*1 face each other to form an insertion hole 75*b*2 through which a rotatable support part 76*a* of a hook 76 is inserted.

In the above-described housing space P1, a hook receiving part 77 is arranged. The hook receiving part 77 has an external appearance in a thick rectangular shape, and is provided, on the center side, with a through hole 77*a* through which the rotatable support part 76*a* of the hook 76 is inserted from the lower side (Z2 side). Further, the hook receiving part 77 is provided to come into surface contact with the lower surface sides of the pair of short piece parts 75*b*, and fixed to the respective short piece parts 75*b* by screws and so on. The fixing of the short piece parts 75*b* to the hook receiving part 77 makes the position of the brackets 75 fixed.

On the upper surface side of the hook receiving part 77, a recessed part 77*b* is provided. In the recessed part 77*b*, a shaft bearing B2 is housed. The shaft bearing B2 is, for example, a thrust bearing, and rotatably supports a support nut 78 arranged on the top of the shaft bearing B2. Note that on the lower surface side of the support nut 78, a recessed part 78*a* for housing the upper side of the shaft bearing B2 is provided.

On the inner peripheral side of the support nut 78, a threaded hole 78*b* is provided, and a male thread part 76*b* on the outer peripheral side of the rotatable support part 76*a* of the hook 76 is screwed into the threaded hole 78*b*. Further, a locking pin 79 is inserted into the support nut 78 and the rotatable support part 76*a*, whereby the threaded hole 78*b* and the male thread part 76*b* are configured such that their screwed state is not loosened.

The hook 76 has the rotatable support part 76*a* and a hook main body part 76*c*. The rotatable support part 76*a* is a portion projecting upward further than is the hook main body part 76*c*, and is provided having a circular shape in a cross-section. On the outer peripheral side on the upper side of the rotatable support part 76*a*, the male thread part 76*b* is provided, and the male thread part 76*b* is screwed into the threaded hole 78*b*. Further, the hook main body part 76*c* is a portion on which a cargo is hooked, and has an external appearance in a hook shape.

To the hook main body part 76*c*, a lever 76*d* for preventing the hooked cargo from coming off it. The lever 76*d* has one end side located on the upper side (Z1 side)), and provided to be pivotable on the pivot 76*e* which is located on the one end side as a pivot. Further, the other end side of the lever 76*d* is located on the lower side (Z2 side) and provided to abut on the inner periphery of the tip side of the hook main body part 76*c*. The lever 76*d* is provided such that biasing force by a not-illustrated spring acts thereon to cause the other end side to abut on the inner periphery of the tip side of the lever 76*d* at all times. Thus, in a state where no external force acts on the lever 76*d*, the closed state of the lever 76*d* can be maintained to prevent the lever 76*d* from opening and the cargo from dropping.

<8. Regarding the Counterweight 80>

Subsequently, the counterweight 80 will be described. As illustrated in FIG. 1 to FIG. 7, the rope hoist 10 is provided with the counterweight 80. The counterweight 80 is provided to achieve a balance in the width direction (Y-direction) of the rope hoist 10. More specifically, the rope drum mechanism 30 composed of many components is provided on the other end side (Y2 side) in the width direction (Y-direction) of the rope hoist 10, and has a relatively heavy weight. To achieve a weight balance with the rope drum mechanism 30, the counterweight 80 is coupled to the one end side (Y1 side) in the width direction (Y-direction) of the coupling bar 24.

The counterweight 80 is a plate-shaped member composed of a thick steel plate or the like, and is provided to spread over the pair of coupling bars 24. In addition, in this embodiment, the counterweight 80 is provided to have an area in an XZ plane larger than those of the control unit 90 and the braking resistor 100. Therefore, the counterweight 80 is provided to have a weight relatively large but sufficiently smaller than the total weight of the rope drum mechanism 30. Therefore, to achieve a balance in moment in the width direction (Y-direction), the distance between the counterweight 80 and the front-rear frame 21 on the one side (Y1 side) is provided longer than the distance between the rope drum mechanism 30 and the front-rear frame 21 on the other side (Y2 side).

Such an arrangement of the counterweight 80 provides the relatively large space SP between the intermediate sheave body 50 and the counterweight 80 as illustrated in FIG. 3, FIG. 4, FIG. 7 and so on.

<9. Regarding the Control Unit 90>

Subsequently, the control unit 90 will be described. The control unit 90 is a portion that controls drive of the rope hoist 10 including the drum motor 33, the traversing motor 42 and so on. Therefore, in the control unit 90, a control device for executing the control of them is arranged. Note that examples of the control device include a main control unit, a motor driver, a power supply and so on that administer control of the whole, and they are covered by a cover member 91. The control unit 90 is also provided with a braking circuit for performing a control when passing current through the braking resistor 100. The control unit 90 is fixed to a surface on the one side (Y1 side) of the counterweight 80 by a screw or the like. As the main control unit and the motor driver, a hoist inverter control device (not illustrated) and a traversing device inverter control device (not illustrated) are used.

<10. Regarding the Braking Resistor 100>

Subsequently the braking resistor 100 will be described. The braking resistor 100 corresponds to a braking resistor part and is provided to process the regenerative electric power generated when the drum motor 33 is operated to lower the cargo, and controls the current flowing through the braking resistor part by the hoist inverter control device to thereby cause it to exert the regenerative braking ability. The braking resistor 100 includes a resistor element (not illustrated), and passes electric energy returned from the drum motor 33 through the resistor element to thereby convert the electric energy to heat. Then, through the conversion to heat, the regenerative electric power of the drum motor 33 is processed (converted to heat and released). In addition to the above, the braking resistor 100 may be used to process also the regenerative electric power of the traversing motor 42. In this case, it is easier to provide resistor elements of a control resistor part separately for the drum motor 33 and the traversing motor 42, but it is also possible to commonly use a resistor element. Besides, the braking resistor that processes the regenerative electric power of the traversing motor 42 may be arranged in the cover member 91 together with the hoist inverter control device and the traversing device inverter control device. In this case, the hoist inverter control device, the traversing device inverter control device, and the braking resistor that processes the regenerative electric power of the traversing motor 42 covered by the cover member 91 are air-cooled in the cover member 91, and air-cooled by heat release to the outside via the cover member 91. The counterweight 80 includes a function of thermally shielding the braking resistor that processes the regenerative electric power of the drum motor 33 and the control device arranged in the cover member 91 by heat capacity of the counterweight 80 and surface area of the counterweight 80, and is configured to contribute also to the heat release to the outside.

Note that as the resistor element of the braking resistor 100, any resistor element may be used as long as it can cope with large current such as an enamel resistor, a cement resistor or the like.

FIG. 18 is a perspective view illustrating the internal configuration of the braking resistor 100. As illustrating in FIG. 18, the braking resistor 100 includes resistor units 101 in which heat release fin members 102 are arranged to surround the not-illustrated resistor element, and the resistor units 101 are fixed to the counterweight 80 via attachment stays 103 by screws or the like. A resistor cover 104 of the braking resistor 100 is attached in an opened state to the counterweight 80 as described above, whereby the heat is conducted also to the counterweight 80 so that the counterweight 80 can fulfill the function as a heat sink plate.

Besides, the resistor units 101 are entirely covered by the resistor cover 104, and the resistor cover 104 is provided with many heat release slits 104*a* being opening portions for heat release. In this embodiment, the heat release slits 104*a* are each provided in a long perforation shape, and configured such that the heat release slits 104*a* at multiple tiers are arranged in a plurality of rows.

Here, the braking resistor 100 is attached to a surface on the other side (Y2 side) in the width direction (Y-direction) of the counterweight 80. Therefore, the braking resistor 100 is provided to project to the space SP side. FIG. 19 is a plan view illustrating the appearance of the braking resistor 100 projecting to the space SP. The braking resistor 100 is for a braking resistor for the drum motor 33, and a braking resistor (not illustrated) used for processing the regenerative electric power of the traversing motor is attached to the surface on the one side (Y1 side) in the width direction (Y-direction) of the counterweight 80, and is attached inside or outside of the cover member 91.

As illustrated in FIG. 19, the braking resistor 100 is arranged not overlapping with other members such as the traversing motor 42, the pair of coupling bars 24 and so on even in the vertical direction (Z-direction). Therefore, the dimension of the braking resistor 100 in the vertical direction (Z-direction) can be made large. Further, the dimension of the rope hoist 10 in the vertical direction (Z-direction) can also be made small. Further, because the dimension in the vertical direction (Z-direction) can also be made small, the cargo suspended from the hook 76 can be raised by an amount corresponding to the reduction in dimension.

The rope hoist 10 needs to be satisfactorily mounted on the rail R also in a case where the rail R has an assumed maximum width (including a case where a plurality of rails R are arranged including a case where two rails R are arranged). Therefore, even when the rail R has the assumed maximum width, the front-rear frame 21 on the one side needs to be moved to the one side (Y1 side) in the width direction (Y-direction) with respect to the coupling bars 24 into a state where the wheel 41 is movable upward while going around the flange part R1. More specifically, when the wheel 41 is mounted on the rail R having the assumed maximum width, the wheels 41 on both sides in the width direction (Y-direction) need to be moved upward while going around the flange parts R1 for the mounting.

Here, the position of the front-rear frame 21 on the one side (Y1 side) in the case where the wheel 41 is mounted on the rail R having the assumed maximum width is regarded as a reference position, and a dimension of the intermediate sheave body 50, at the reference position, between a portion nearest the one side (Y1 side) in the width direction (Y-direction) of the intermediate sheave body 50 and a portion nearest the other side (Y2 side) in the width direction (Y-direction) of the braking resistor 100 is regarded as L1. In mounting, the front-rear frame 21 on the one side comes to be moved to the braking resistor 100 side by an amount of a total of the widths of the wheels 41 on both sides and a margin with respect to the dimension L1.

It is necessary to prevent, even though the front-rear frame 21 on the one side moves, the intermediate sheave body 50 and the braking resistor 100 from interfering with each other. Therefore, the space SP needs to be set to equal to or more than a dimension obtained by adding the total of the widths of the two wheels 41 and the margin. Note that as the dimension of the margin, an appropriate dimension can be set and the margin may be zero.

Further, the dimension may be set as follows. More specifically, the above-described dimension L1 may be a dimension obtained by adding the total of the widths of the flange parts R1 of the two rails R on which the wheels 41 are mounted and a margin. As is clear from FIG. 5 and FIG. 6, the width of the flange part R1 of the rail R is larger than the width of the wheel 41. Therefore, with the setting of such a dimension, preferable mounting becomes possible.

Here, as illustrated in FIG. 5 and FIG. 6, the lower end side (Z2 side) of the counterweight 80 is provided at the equal height to the lower end side (Z2 side) of the rope drum mechanism 30 (both their lower end sides are located on a one-dotted chain line M in FIG. 5 and FIG. 6). In addition, the height on the lower end side (Z2 side) of the braking resistor 100 is located on the upper side (Z1 side) than the height on the lower end side (Z2 side) of the counterweight 80. Therefore, it is possible to prevent the dimension of the rope hoist 10 in the height direction from decreasing as in the case where the lower end side (Z2 side) of one of them projects downward.

<11. Operation and Effect>

In the rope hoist 10 in the above configuration, the counterweight 80 is attached to the one side (Y1 side) in the width direction (Y-direction) of the frame structure 20, and the counterweight 80 is attached on the opposite side to the rope drum mechanism 30. Further, in the space SP between the counterweight 80 and the front-rear frame 21 on the one side (Y1 side), the braking resistor 100 that processes the regenerative electric power in the inverter control is arranged. Therefore, even when the braking resistor 100 is attached to the rope hoist 10, it is possible to prevent the rope hoist 10 from increasing in dimension because the braking resistor 100 is attached utilizing the vacant space.

Further, in this embodiment, the intermediate sheave body 50 that leads the wire rope W to be wound around the rope drum 31 to the hook sheaves 71 side is arranged in the above-described space SP between the counterweight 80 and the front-rear frame 21 on the one side (Y1 side). When the case where the rope hoist 10 is mounted on the rails R each having the assumed maximum width is regarded as a reference, the distance in the width direction (Y-direction) between the braking resistor 100 and the intermediate sheave body 50 in the space SP is set to a distance obtained by adding twice the widths of the pair of wheels 41 in the width direction (Y-direction) and a margin. Therefore, when mounting on the rails R each having the assumed maximum width, the front-rear frame 21 on the one side (Y1 side) in the width direction (Y-direction) is further moved to the one side (Y1 side) in the width direction (Y-direction), whereby the rope hoist 10 can be easily mounted without interference with the flange parts R1.

Further, in this embodiment, the braking resistor 100 is provided at a position where the braking resistor 100 does not interfere in the vertical direction (Z-direction) with the traversing motor 42 that drives the pair of coupling bars 24 and the wheels 41. Therefore, it becomes possible to arrange the braking resistor 100 at the position where the braking resistor 100 and the traversing motor 42 overlap with each other in the vertical direction (Z-direction), thereby making it possible to reduce the height of the rope hoist 10. Further, it is possible to reduce the dimension in the vertical direction (Z-direction) of the rope hoist 10, thereby making it possible to raise the cargo suspended from the hook 76 by an amount corresponding to the reduction in dimension.

Further, in this embodiment, the lower end side (Z2 side) of the braking resistor 100 is located on an upper side than the lower end side (Z2 side) of the counterweight 80. In addition, the lower end side (Z2 side) of the counterweight 80 is provided at a position of height about equal to the lower end side (Z2 side) of the rope drum mechanism 30. Therefore, it is possible to prevent the dimension of the rope hoist 10 in the height direction from increasing as in the case where the lower end side (Z2 side) of one of them projects downward. Further, since the lower end side (Z2 side) of the counterweight 80 is provided at a height position about equal to the lower end side (Z2 side) of the rope drum mechanism 30, the rope hoist 10 can keep a horizontal positional relationship in the width direction (Y-direction) when the rope hoist 10 is placed on the floor or the like before mounted. This facilitates the operation of assembling or the like.

Second Embodiment

Next, a rope hoist 10 according to the second embodiment of the present invention will be described. Note that the configuration of other than portions described below of the rope hoist 10 according to the second embodiment is the configuration basically common to that of the above-described rope hoist 10 according to the first embodiment. Therefore, description of details of common portions will be omitted.

Figure 20:
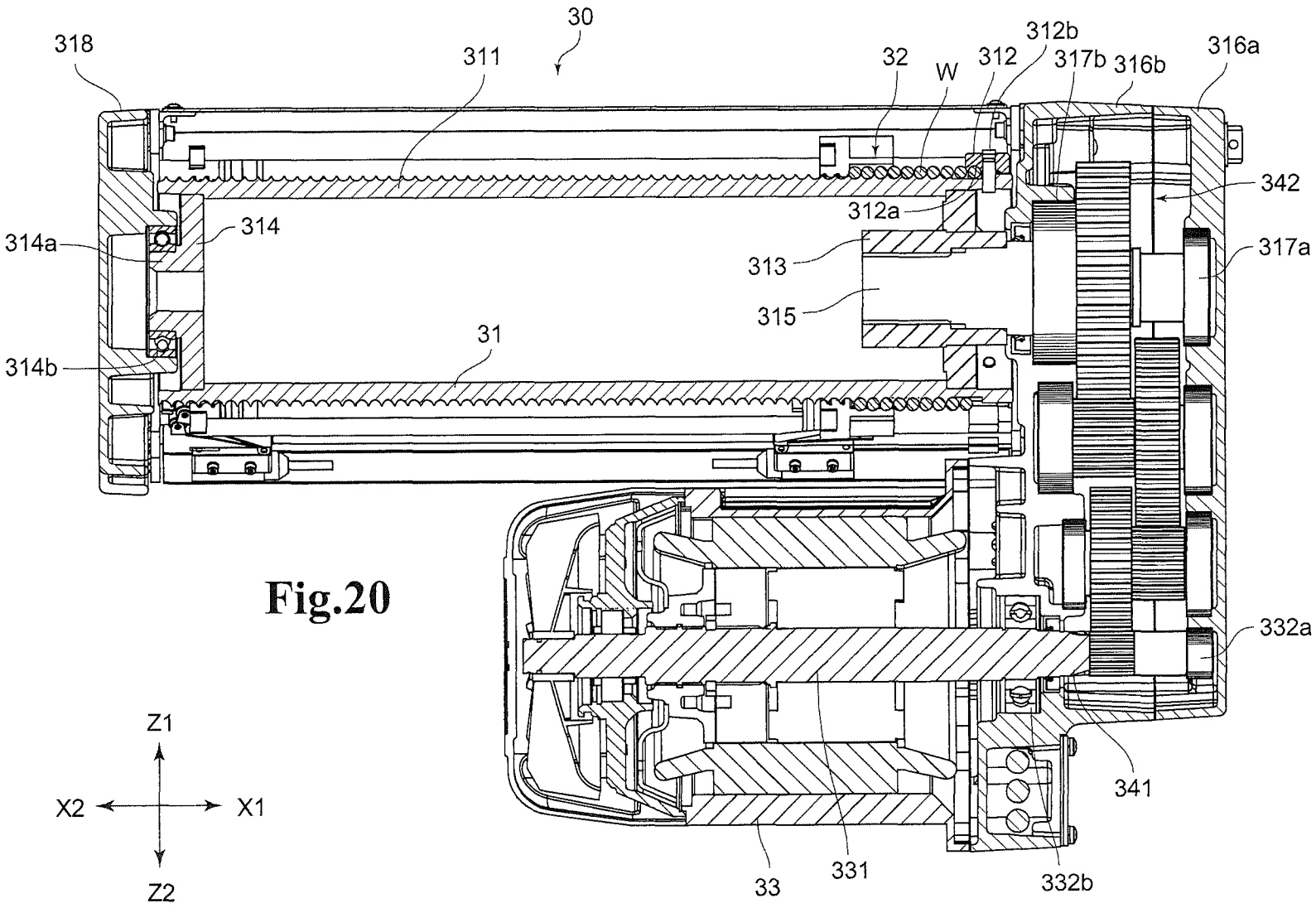
FIG. 20 is a side view illustrating the configuration of a rope drum of a rope hoist according to a second embodiment of the present invention, and illustrating the vicinity of the rope drum and the vicinity of a drum motor in a cross section.

FIG. 20 is a side view illustrating the configuration of a rope drum 31 of the rope hoist 10 according to the second embodiment of the present invention, and illustrating the vicinity of the rope drum 31 and the vicinity of a drum motor 33 in a cross section. As illustrated in FIG. 20, the attaching position of a rope pressing metal fitting 312 in the rope drum 31 is different in the second embodiment of the present invention. More specifically, in this embodiment, the rope pressing metal fitting 312 is attached to the one end side (front side; X1 side) of the rope drum 31, and the one end side of the wire rope W is fixed by the rope pressing metal fitting 312 on the one end side (X1 side).

In contrast to the above, in the above-described rope hoist 10 according to the first embodiment, the rope pressing metal fitting 312 is attached to the other end side (rear side; X2 side) of the rope drum 31, and the one end side of the wire rope W is fixed by the rope pressing metal fitting 312 on the other end side (X2 side) as illustrated in FIG. 8.

Note that the configuration of the rope pressing metal fitting 312 according to the second embodiment also has the same configuration as that of the above-described rope pressing metal fitting 312 according to the first embodiment. More specifically, the rope pressing metal fitting 312 includes a recessed part 312*a* where the wire rope W is located, and a screw 312*b* being a fastening means is firmly screwed into the rope drum 31 with the wire rope W located in the recessed part 312*a*. Thus, the one end side of the wire rope W is fixed to the rope drum 31.

Figure 21:
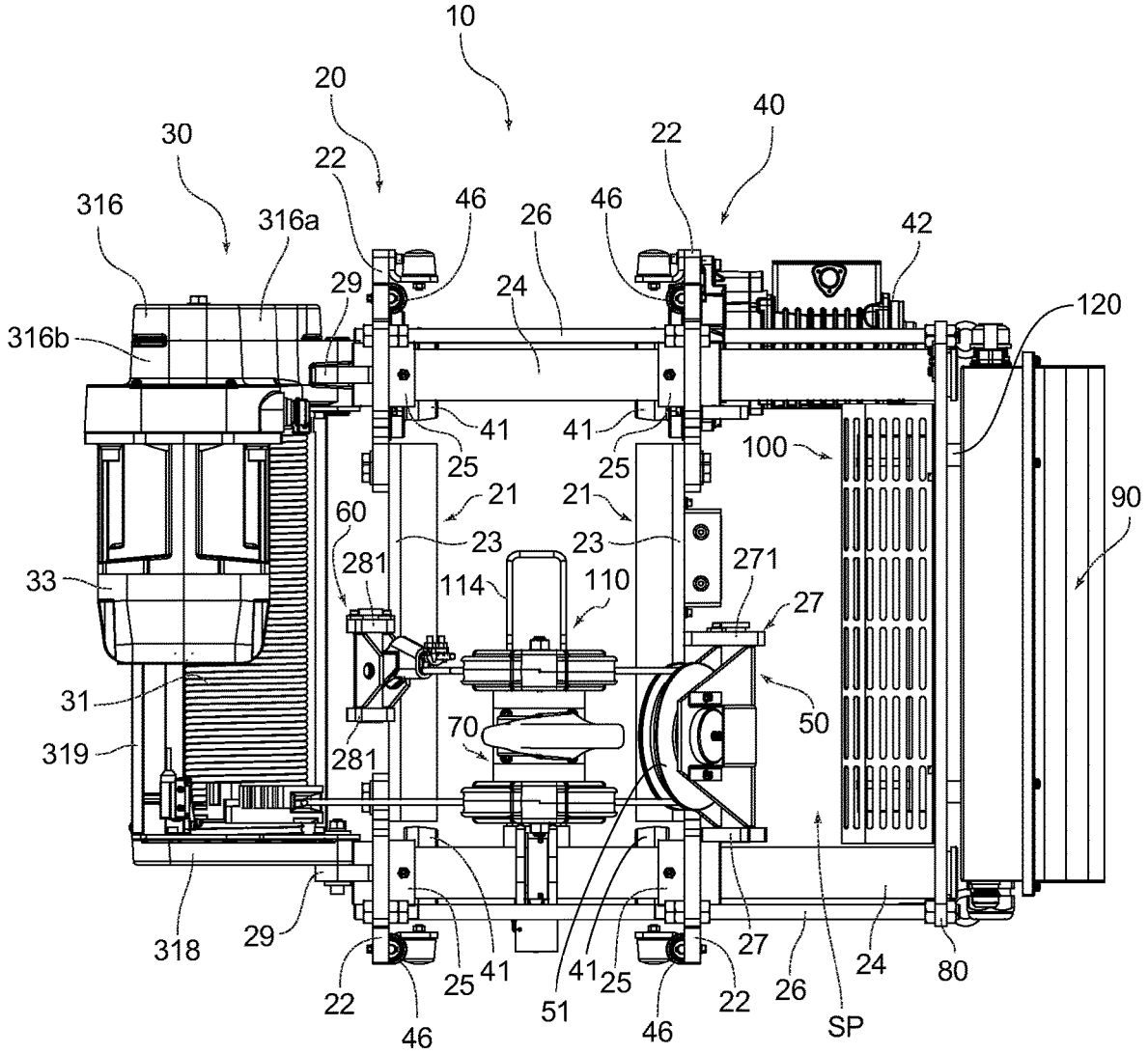
FIG. 21 is a bottom view illustrating the configuration of the rope hoist according to the second embodiment when viewed from the lower side.

FIG. 21 is a bottom view illustrating the configuration of the rope hoist 10 according to the second embodiment when viewed from the lower side. As is clear from comparison between FIG. 21 and FIG. 4, at the time when the wire rope W is hoisted to raise the hook block 70, the wire rope W is wound around the rope drum 31, and as is clear from FIG. 4, the wire rope W is extended toward the hook block 70 from the one end side (X1 side) of the rope drum 31 in the vicinity of a winding limit where the wire rope W is completely wound around the rope drum 31 in the first embodiment. On the other hand, as is clear from FIG. 21, the wire rope W is extended toward the hook block 70 from the other end side (X2 side) of the rope drum 31 in the vicinity of a winding limit where the wire rope W is completely wound around the rope drum 31 in the second embodiment.

Further, as is clear from FIG. 21, a spiral groove 311 of the rope drum 31 in the second embodiment is formed in a direction reverse to that of the spiral groove 311 of the rope drum 31 in the first embodiment illustrated in FIG. 4. Specifically, the spiral groove 311 of the rope drum 31 in the second embodiment illustrated in FIG. 21 is formed in a right-hand thread shape. On the other hand, the spiral groove 311 of the rope drum 31 in the first embodiment illustrated in FIG. 4 is formed in a left-hand thread shape. Therefore, when winding the wire rope W and when winding off (rewinding) the wire rope W, the rotation directions of the rope drum 31 in the first embodiment and the rope drum 31 in the second embodiment are the same.

With the above configuration, in the configuration of the second embodiment, the hook block 70 is close to the coupling bar 24 located on the other end side (X2 side) in the vicinity of the winding limit of the wire rope Was is clear from FIG. 21. In contrast to this, in the configuration of the first embodiment, the hook block 70 is close to the coupling bar 24 located on the one end side (X1 side) in the vicinity of the winding limit of the wire rope W as is clear from FIG. 4.

Note that in this embodiment, as illustrated in FIG. 21, a direct-acting switch mechanism 110 is attached to the coupling bar 24 located on the other end side (X2 side). The direct-acting switch mechanism 110 includes a detection lever member 114, so that when the hook block 70 is raised, the detection lever member 114 collide with the hook block 70, whereby the detection lever member 114 is turned. Thus, the upper limit of the hook block 70 is detected. When the direct-acting switch mechanism 110 detects the upper limit of the hook block 70, a detection signal is transmitted to the control unit 90, and the operation of the drum motor 33 is stopped based on the detection signal.

Besides, in the second embodiment, as it goes along the wire rope W extended from the rope drum 31, the wire rope W extended from the rope drum 31 goes through the hook sheave 71 located on the other end side (X2 side) and is wound around the intermediate sheave 51 of the intermediate sheave body 50. Then, the wire rope W goes from the other end side (X2 side) to the one end side (X1 side) along the intermediate sheave 51, then goes through the hook sheave 71 located on the one end side (X1 side) and reaches the rope fixing member 60. Then, to the rope fixing member 60, the terminal of the wire rope W is fixed.

Note that in the rope hoist 10 in the first embodiment, the relationship between the one end side (X1 side) and the other end side (X2 side) is reversed as is clear from FIG. 4. More specifically, as it goes along the wire rope W extended from the rope drum 31, the wire rope W extended from the rope drum 31 goes through the hook sheave 71 located on the one end side (X1 side) and is wound around the intermediate sheave 51 of the intermediate sheave body 50. Then, the wire rope W goes from the one end side (X1 side) to the other end side (X2 side) along the intermediate sheave 51, and then goes through the hook sheave 71 located on the other end side (X2 side), and the terminal of the wire rope W is fixed to the rope fixing member 60.

In the above configuration in the second embodiment, for example, in a state where the hook block 70 is raised when not in use, the hook block 70 can be located on the other end side (X2 side). Therefore, when the rope hoist 10 is not in use, the imbalance in weight between the one end side (X1 side) and the other end side (X2 side) can be reduced. More specifically, in the rope hoist 10 in the first embodiment, the center of gravity when not in use is in a state of being eccentric to the one end side (X1 side) due to the action of the weights of the drum motor 33 and the traversing motor 42 and due to the action of the weight of the hook block 70. Meanwhile, in the rope hoist 10 in the second embodiment, the hook block 70 when not in use can be located on the other end side (X2 side), thereby making it possible to make the center of gravity when not in use closer to the center in the longitudinal direction (X-direction) to reduce the imbalance in weight between the one end side (X1 side) and the other end side (X2 side).

In particular, time when the rope hoist 10 is not in use is overwhelmingly longer than time when it is in use. Therefore, the weight balance can be improved to uniform weights applied on the respective wheels 41 so as to prevent the life of a specific wheel 41 from being earlier expired.

Further, in the rope hoist 10 according to the first embodiment, as illustrated in FIG. 4, the control unit 90 is directly attached to the counterweight 80. In contrast to this, in the rope hoist 10 according to the second embodiment, as illustrated in FIG. 21, the control unit 90 is attached to the counterweight 80 via spacers 120. More specifically, the control unit 90 is not directly attached to the counterweight 80 so that air can enter between the control unit 90 and the counterweight 80.

Here, to the surface on the opposite side (the surface on the Y2 side) of the counterweight 80, the braking resistor 100 is attached. The braking resistor 100 is a portion that converts the electric energy to heat as described above. Since the braking resistor 100 is attached to the counterweight 80 as described above, the heat generated in the braking resistor 100 is transferred to the counterweight 80. However, in the rope hoist 10 in the second embodiment, since the control unit 90 is attached to the counterweight 80 via the spacers 120, it is possible to prevent the heat transferred to the counterweight 80 from being transferred to the control unit 90.

Further, the configuration in which the spacers 120 are provided to provide a gap between the counterweight 80 and the control unit 90 enables employment of a configuration in which, for example, the coupling bars 24 and so on project from the surface on the Y1 side of the counterweight 80 (later described).

Note that in the configuration in the second embodiment, the spacers 120 are configured such that four spacers 120 in total, that is, two spacers 120 in the vertical direction (Z-direction) and two spacers 120 in the width direction (Y-direction), are arranged. However, if it is possible to stably support the control unit 90 with respect to the counterweight 80, any number of spacers 120 may be provided. Further, the material of the spacer 120 may be metal or may be heat-resistant resin or ceramic. Note that examples of the heat-resistant resin include a phenol resin, a PPS (polyphenylenesulfide) resin and so on, and other resins may be used. Further, the spacers 120 may be integrated with the cover member 91 of the control unit 90.

Figure 22:
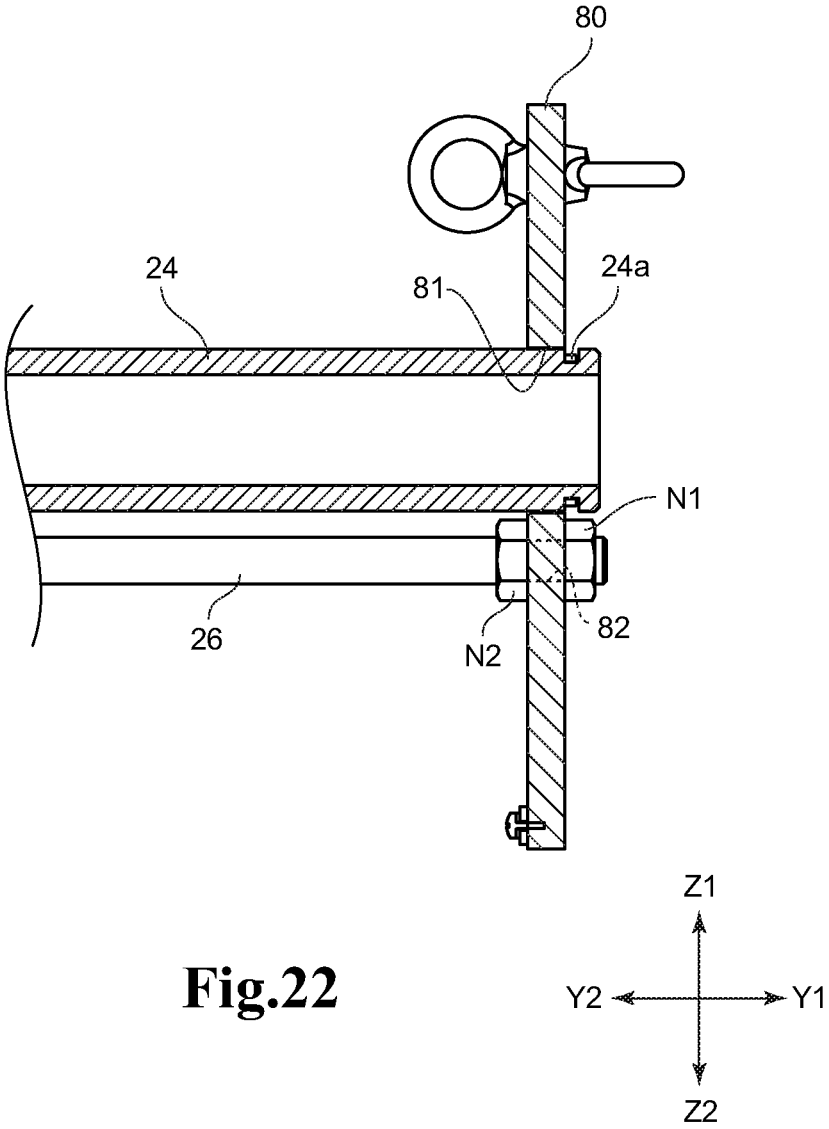
FIG. 22 is a front cross-sectional view illustrating the configuration in the vicinity of a counterweight in the rope hoist according to the second embodiment of the present invention.
Figure 23:
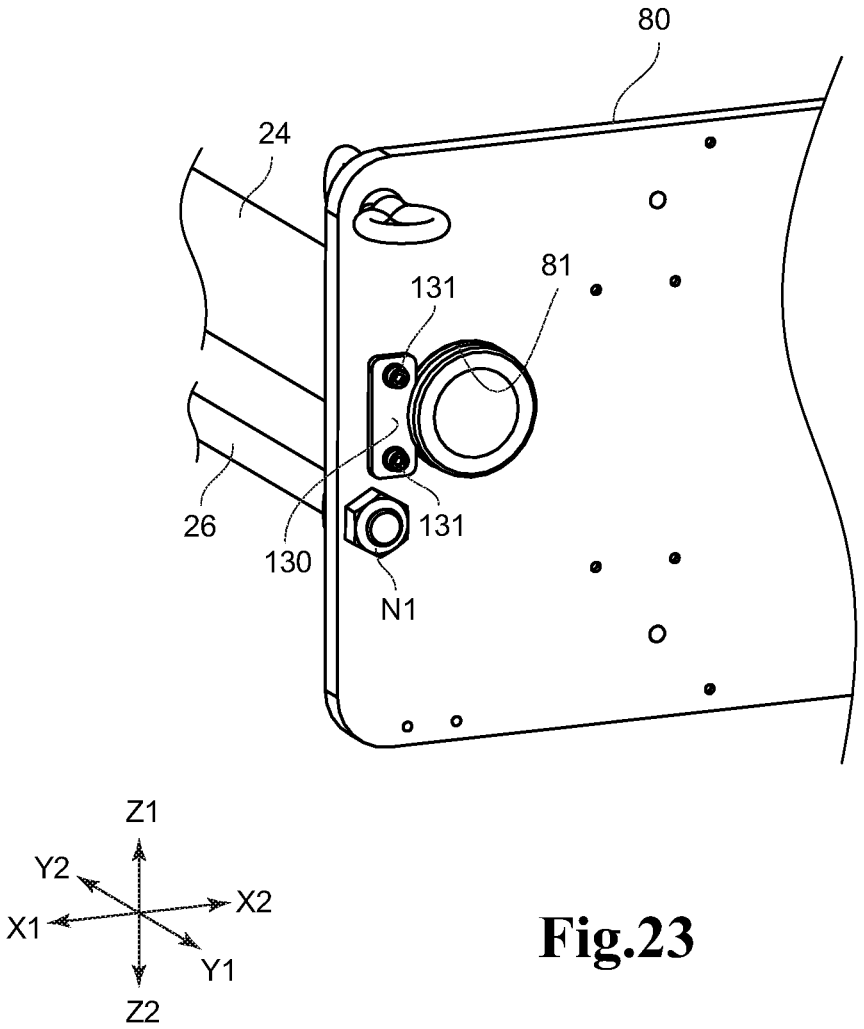
FIG. 23 is a perspective view illustrating the configuration in the vicinity of the counterweight of the rope hoist according to the second embodiment of the present invention.

FIG. 22 is a front cross-sectional view illustrating the configuration in the vicinity of the counterweight 80 in the rope hoist 10 according to the second embodiment. FIG. 23 is a perspective view illustrating the configuration in the vicinity of the counterweight 80 of the rope hoist 10 according to the second embodiment. As illustrated in FIG. 22 and FIG. 23, in the configuration according to the second embodiment, the counterweight 80 is provided with an insertion hole 81, and the coupling bar 24 is inserted through the insertion hole 81 by fit or the like. In the configuration according to the second embodiment, the coupling bar 24 is a hollow shaft.

Further, as illustrated in FIG. 22 and FIG. 23, a key groove 24*a* is provided at the end portion on the Y1 side of the coupling bar 24. Into the key groove 24*a*, a key plate 130 is inserted, and the key plate 130 is attached to the counterweight 80 via screws 131 and so on. This fixes the attachment position of the counterweight 80 to the coupling bar 24.

Further, the counterweight 80 is also provided with a communication hole 82 through which the coupling assist bar 26 being a threaded rod is inserted. In a state where the coupling assist bar 26 is inserted through the communication hole 82, the nuts N1, N2 are screwed onto the coupling assist bar 26, the nuts N1, N2 being screwed from both surface sides of the counterweight 80 at that time. This can adjust the position in the Y-direction of the counterweight 80. Note that the key plate 130 has a function to fix the position with respect to the coupling bar 24, and in the case where the key plate 130 is detached, it is possible to freely change the position of the counterweight 80 with respect to the coupling bar 24 by adjusting the screwing of the nuts N1, N2.

Figure 24:
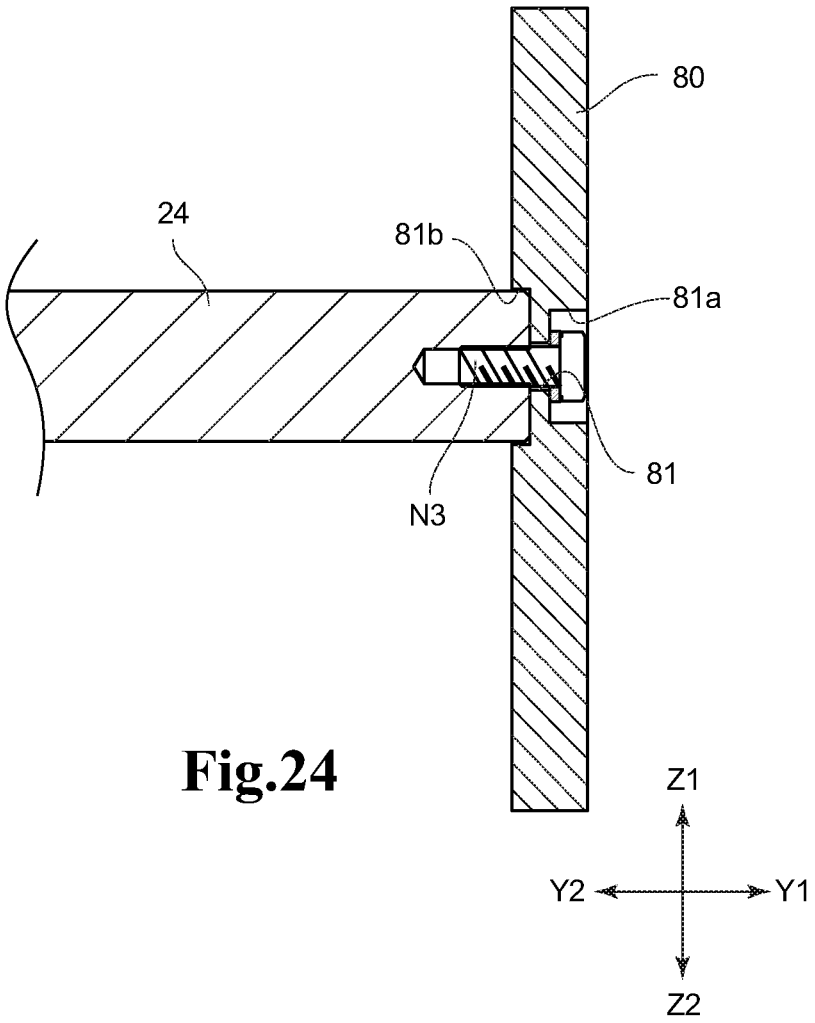
FIG. 24 is a front cross-sectional view illustrating the configuration in the vicinity of the counterweight in the rope hoist according to the first embodiment of the present invention.

FIG. 24 is a front cross-sectional view illustrating the configuration in the vicinity of the counterweight 80 in the rope hoist 10 according to the first embodiment. As illustrated in FIG. 24, to directly attach the counterweight 80 to the control unit 90 in the first embodiment, a configuration in which the coupling bar 24 does not project to the Y1 side is employed (refer to FIG. 4 and so on). In addition, the coupling bar 24 is a solid shaft, and a threaded hole 24*b* is formed at the end portion on the Y1 side of the solid shaft. Therefore, a screw N3 is screwed into the threaded hole 24*b* from the end portion on the Y1 side of the coupling bar 24. This makes it possible to fix the coupling bar 24 to the counterweight 80.

Specifically, as illustrated in FIG. 24, a recessed housing part 81*a* that houses the heat portion of the screw N3 is provided continuously to the insertion hole 81, on the Y1 side of the insertion hole 81 penetrating the counterweight 80. The recessed housing part 81*a* is provided in a depth with which the heat portion of the screw N3 does not project from the surface on the Y1 side of the counterweight 80. Further, a recessed fitting part 81*b* to which the coupling bar 24 is fitted when the coupling bar 24 is brought into contact with the counterweight 80, is provided continuously to the insertion hole 81 on the Y2 side of the insertion hole 81. Therefore, the end portion on the Y1 side of the coupling bar 24 is fitted into the recessed fitting part 81*b*, and in this state, the screw N3 is inserted from the recessed housing part 81*a* toward the insertion hole 81 and screwed into the threaded hole 24*b*. This makes it possible to fix the counterweight 80 to the end portion on the Y1 side of the coupling bar 24.

Note that in the first embodiment, the counterweight 80 has the insertion hole 81, the recessed housing part 81*a*, and the recessed fitting part 81*b*,_which are provided in a recessed shape with three steps. Therefore, the counterweight 80 is large in thickness. Alternatively, a configuration in which the counterweight 80 is not provided with the recessed fitting part 81*b* may be employed. Further, when the cover member 91 of the control unit 90 has a hole or the like to escape the screw N3, the recessed housing part 81*a* does not need to be provided.

As described above, the rope hoist 10 according to the first embodiment employs the configuration in which the control unit 90 is directly attached to the counterweight 80, and is therefore configured such that the coupling bar 24 does not project from the Y1 side of the counterweight 80. Accordingly, the dimension in the Y-direction can be reduced.

On the other hand, in the rope hoist 10 according to the second embodiment, the control unit 90 is attached to the counterweight 80 via the spacers 120. Therefore, it is possible to prevent the heat generated in the braking resistor 100 and transferred to the counterweight 80 from being transferred to the control unit 90. Further, utilizing the above-described gap, it is also possible to employ the configuration in which, for example, the coupling bar 24 and the like project from the surface on the Y1 side of the counterweight 80. Accordingly, it is unnecessary to form the insertion hole 81 in the recessed shape with three steps, thus simplifying the step in machining the holes or the like.

Modification Examples

The embodiments of the present invention have been described, and the present invention is variously modified in addition to them. Hereinafter, they will be described.

In each of the above-described embodiments, when the position of the front-rear frame 21 on the one side (Y1 side) in the case where the wheel 41 is mounted on the rail R having the assumed maximum width is regarded as a reference position, the dimension L1 is set to the dimension obtained by adding the total of the widths of the wheels 41 on both sides and the margin. However, the dimension L1 may be a dimension obtained by adding a dimension between insides (the sides in contact with the flange parts R1) of the guide rollers 46 in the width direction (Y-direction), twice the distance between the inside of the guide roller 46 and the inside (on the center side of the rail R) of the wheel 41, and a margin.

Further, in each of the above embodiments, the drum motor 33 is described as being inverter-controlled. However, the traversing motor 42 may also be the one to be inverter-controlled.

Further, in each of the above embodiments, the rope hoist 10 including the trolley mechanism 40 having the traversing motor 42 is described. However, the present invention may be applied to a rope hoist including a manual type trolley mechanism but not including the traversing motor 42 as long as it includes the braking resistor 100 for inverter-controlling the drum motor 33.

Further, the rope hoist 10 in each of the above embodiments is a so-called 4/1 reeving type in which one end of the wire rope W is fixed to the rope drum 31, the other end of the wire rope W is fixed to the rope fixing member 60, and the intermediate sheave body 50 is arranged between them. However, the present invention is applied not only to the 4/1 reeving type. For example, the present invention may be applied to a so-called 2/1 reeving type in which one end of the wire rope W is fixed to the rope drum 31, the other end of the wire rope W is fixed to the rope fixing member 60, but the intermediate sheave body is not used. Further, the present invention may be applied to a so-called 4/2 reeving type in which one end of the wire rope W is fixed to the rope drum 31, the other end of the wire rope W is fixed to the other rope drum (the spiral groove of this rope drum is in an opposite direction to that of the rope drum 31), and the intermediate sheave body 50 is arranged between them.

The invention claimed is:

1. A rope hoist which enables movement along a rail direction by driving a wheel with respect to a rail, and hoists and lowers a cargo suspended therefrom via a wire rope by changing a winding length of the wire rope by rotation of a rope drum, the rope hoist comprising:

a frame structure which rotatably supports the wheel;

a rope drum mechanism which is provided on one side of the frame structure in a width direction orthogonal to the rail direction, and comprises the rope drum and a drum motor which rotates the rope drum;

a counterweight which is provided on another side of the frame structure in the width direction and is arranged in a state of having a space with respect to the frame structure; and a control unit which is attached to a side of the counterweight, the side being opposite to a side facing the rope drum mechanism in the width direction, and inverter-controls the drum motor, a braking resistor part which processes regenerative electric power in the inverter control is attached in a state of being located in the space.

2. The rope hoist according to claim 1, wherein the frame structure comprises a pair of front-rear frames which are arranged along the rail direction and arranged to be separate from each other corresponding to a width of the rail and rotatably support the wheel, and a pair of coupling bars which extend along the width direction and couple the pair of front-rear frames, wherein as the pair of front-rear frames, a drum-side frame located on one side in the width direction and a weight-side frame located on another side in the width direction are provided, wherein the weight-side frame is fixed to the coupling bar via a fastening means, and is enabled to move with respect to the pair of coupling bars by releasing the fixation of the fastening means when the rope hoist is mounted on the rail, wherein in the space, an intermediate sheave body is arranged which leads the wire rope to be wound around the rope drum to a hook sheave side, and wherein the space is set to be able to make an interval at which a pair of the wheels face each other in the width direction equal to or more than the width of the rail having an assumed maximum width.

3. The rope hoist according to claim 1, wherein the frame structure comprises a pair of front-rear frames which are arranged along the rail direction and arranged to be separate from each other corresponding to a width of the rail and rotatably support the wheel, and a pair of coupling bars which extend along the width direction and couple the pair of front-rear frames, wherein as the pair of front-rear frames, a drum-side frame located on one side in the width direction and a weight-side frame located on another side in the width direction are provided, wherein the weight-side frame is fixed to the coupling bar via a fastening means, and is enabled to move with respect to the pair of coupling bars by releasing the fixation of the fastening means when the rope hoist is mounted on the rail, wherein in the space, an intermediate sheave body is arranged which leads the wire rope to be wound around the rope drum to a hook sheave side, and wherein a distance in the width direction between the braking resistor part and the intermediate sheave body in the space is set to be equal to or more than a distance obtained by adding the width of the wheel and a margin.

4. The rope hoist according to claim 1, wherein the frame structure comprises a pair of front-rear frames which are arranged along the rail direction and arranged to be separate from each other corresponding to a width of the rail and rotatably support the wheel, and a pair of coupling bars which extend along the width direction and couple the pair of front-rear frames, wherein as the pair of front-rear frames, a drum-side frame located on one side in the width direction and a weight-side frame located on another side in the width direction are provided, wherein the weight-side frame is fixed to the coupling bar via a fastening means, and is enabled to move with respect to the pair of coupling bars by releasing the fixation of the fastening means when the rope hoist is mounted on the rail, wherein in the space, an intermediate sheave body is arranged which leads the wire rope to be wound around the rope drum to a hook sheave side, and wherein when a case where the rope hoist is mounted on the rail having an assumed maximum width is regarded as a reference, a distance in the width direction between the braking resistor part and the intermediate sheave body in the space is set to be equal to or more than a distance obtained by adding twice the widths of the pair of wheels and a margin.

5. The rope hoist according to claim 2, wherein the braking resistor part is provided at a position where the braking resistor part does not interfere, in a vertical direction, with the pair of coupling bars and a traversing motor which drives the wheel.

6. The rope hoist according to claim 1, wherein a lower end side of the braking resistor part is located on an upper side than a lower end side of the counterweight, and wherein the lower end side of the counterweight is provided at a position of height about equal to a lower end side of the rope drum mechanism.

7. The rope hoist according to claim 2, wherein a lower end side of the braking resistor part is located on an upper side than a lower end side of the counterweight, and wherein the lower end side of the counterweight is provided at a position of height about equal to a lower end side of the rope drum mechanism.

8. The rope hoist according to claim 3, wherein a lower end side of the braking resistor part is located on an upper side than a lower end side of the counterweight, and wherein the lower end side of the counterweight is provided at a position of height about equal to a lower end side of the rope drum mechanism.

* * * * *